US007802535B2

(12) United States Patent
Solow

(10) Patent No.: US 7,802,535 B2
(45) Date of Patent: Sep. 28, 2010

(54) ELECTROPNEUMATIC HORN SYSTEM

(75) Inventor: Stanley Solow, Plainview, NY (US)

(73) Assignee: Wolo Mfg. Corp., Deer Park, NY (US)

( * ) Notice: Subject to any disclaimer, the term of this patent is extended or adjusted under 35 U.S.C. 154(b) by 176 days.

(21) Appl. No.: 12/183,826

(22) Filed: Jul. 31, 2008

(65) Prior Publication Data

US 2009/0065291 A1 Mar. 12, 2009

Related U.S. Application Data

(60) Provisional application No. 60/970,365, filed on Sep. 6, 2007, provisional application No. 60/979,525, filed on Oct. 12, 2007, provisional application No. 61/059,172, filed on Jun. 5, 2008.

(51) Int. Cl.
*G10K 9/04* (2006.01)
*G10K 9/12* (2006.01)

(52) U.S. Cl. ..... 116/142 FP; 340/388.1; 340/398.1; 340/404.1

(58) Field of Classification Search ..... 116/142 FP, 116/137 R, 138, 140, 142 R, 145, 142 FV, 116/59; 181/152, 159; 340/388.1, 388.4, 340/391.1, 404.1, 398.1; D10/120
See application file for complete search history.

(56) References Cited

U.S. PATENT DOCUMENTS

D37,313 S 1/1905 Berton-Houel
D46,672 S 11/1914 Hawthorne
D46,917 S 2/1915 Sparks
D51,548 S 12/1917 Coulombe
D52,941 S 2/1919 Aufiero
D53,220 S 4/1919 Genn
D55,293 S 5/1920 Marsico
D55,294 S 5/1920 Marsico
D55,295 S 5/1920 Marsico
D70,279 S 6/1926 Jupp
D73,217 S 8/1927 Abrahams
D73,218 S 8/1927 Abrahams
D74,585 S 2/1928 White
1,698,804 A * 1/1929 Sparks et al. ..... 116/142 R
1,730,192 A 10/1929 CritchField
1,841,535 A 1/1932 Hueber et al.
1,901,187 A 3/1933 Osborne (Continued)

OTHER PUBLICATIONS

PCT/US08/71796 filed Jul. 31, 2008, International Search Report and Written Opinion, 9 pages.

*Primary Examiner*—Amy Cohen Johnson
(74) *Attorney, Agent, or Firm*—Lackenbach Siegel, LLP; Andrew F. Young

(57) ABSTRACT

The present electric horn system includes a monolithic rigid housing member having a receiving opening for fixably housing, in an non-removable and secure manner following assembly, a compressor member, thereby preventing unintended separation and improving a reliability of the electric horn system. An acoustic sound wave generator includes an acoustic duct chambering system associated throughout with the monolithic rigid housing member. The acoustic sound wave generator receives compressed air from the compressor member to produce sound and propagate the same externally. A horn mounting system enables ready attachment of the system to a consumer-desired surface; either mechanically, magnetically, adhesively or via any other known attachment or mounting system. Optional weather and water resistant systems prohibit unintended water access to the electric horn system enabling use of the system in exposed weather conditions for improved user convenience.

34 Claims, 10 Drawing Sheets

U.S. PATENT DOCUMENTS

| | | | | |
|---|---|---|---|---|
| D99,040 | S | 3/1936 | McBroom | |
| D99,177 | S | 4/1936 | Armstrong | |
| D100,139 | S | 6/1936 | Weld | |
| D108,814 | S | 3/1938 | Aufiero | |
| D108,815 | S | 3/1938 | Aufiero | |
| D111,187 | S | 9/1938 | Nielsen | |
| D111,188 | S | 9/1938 | Nielsen | |
| D111,189 | S | 9/1938 | Nielsen | |
| D112,883 | S | 1/1939 | MacPhail et al. | |
| D112,961 | S | 1/1939 | Nielson | |
| D113,046 | S | 1/1939 | Nielsen | |
| D122,160 | S | 8/1940 | Curtis | |
| D124,796 | S | 1/1941 | Peo | |
| 3,124,098 | A | 3/1964 | Thoben | |
| D206,634 | S | 1/1967 | Guthart | |
| D215,978 | S | 11/1969 | Berns | |
| D222,927 | S | 2/1972 | Tsuhata | |
| 3,846,792 | A | 11/1974 | Haigh | |
| 3,886,546 | A | 5/1975 | Ueda | |
| 4,007,703 | A | 2/1977 | Frigo | |
| D243,834 | S | 3/1977 | Leeder | |
| 4,314,522 | A | 2/1982 | Frigo | |
| 4,410,881 | A | 10/1983 | Seyler | |
| 4,429,762 | A | 2/1984 | Cesati | |
| 4,496,021 | A | 1/1985 | Berlant | |
| 4,796,009 | A | 1/1989 | Bierasch | |
| D301,989 | S | 7/1989 | Arduini et al. | |
| D312,057 | S | 11/1990 | Pilka | |
| 5,263,435 | A | 11/1993 | Takahashi | |
| 5,964,978 | A | 10/1999 | Hirooka | |
| 6,294,984 | B1 | 9/2001 | Meister | |
| 6,337,003 | B1 | 1/2002 | Kimokiri et al. | |
| 6,337,730 | B1 | 1/2002 | Ozaki et al. | |
| 6,796,265 | B1 | 9/2004 | Dexter et al. | |
| 6,879,370 | B2 | 4/2005 | Yokoue et al. | |
| 7,038,576 | B2 | 5/2006 | Di Giovani et al. | |
| 7,063,040 | B2 * | 6/2006 | Woods | 116/142 R |
| 7,387,079 | B2 * | 6/2008 | Kruse | 116/59 |
| 7,712,430 | B2 * | 5/2010 | Solow | 116/142 FP |
| 2005/0190339 | A1 | 9/2005 | Yokoue et al. | |

* cited by examiner 340, 343
340, 344
309
213
213A
215
211B
214
325A
306
102'
113B
340
330
307, 307A
341, 342
330
111B
307, 307B
103
316
330
330
111
300
104A
104B
111A
112
106
120
120
124
126'

ELECTROPNEUMATIC HORN SYSTEM

CROSS REFERENCE TO RELATED APPLICATIONS

This application cross references and claims priority from U.S. Prov. App. Ser. Nos. 60/970,365 filed Sep. 6, 2007, 60/979,525 filed Oct. 12, 2007, and 61/059,172 filed Jun. 5, 2008, the entire contents of each of which are also incorporated herein by reference.

FIGURE SELECTED FOR PUBLICATION

FIG. 8

BACKGROUND OF THE INVENTION

1. Field of the Invention

The present invention relates to an electric horn system. More specifically, the present invention relates to an electropneumatic horn system adapted for multiple commercial uses wherein a compressed air generating unit is securely fixed within a monolithic housing during an assembly and enables multi-tonal, particularly bi-tonal sound generation, during a use.

2. Description of the Related Art

The related art involves generally electric and electropneumatic horn constructions and systems. Electropneumatic horns are those which generate sound by generated air flow or compressed air and are considered (very broadly due to their typical electrical operation of compressed air or air-supply valving) to be within the wider grouping of electric horns due to the electric control of the generation of the air flow or compressed air. It should be noted that electric horn constructions also include (in addition to pneumatic sound creation) the creation of electronic sound (e.g. speaker type systems) wherein sound or tone is the result of an electronic signal to a speaker and not the result of an acoustic passage. As a consequence, those of skill in the art will recognize that the use of the phrases electronic, electrical, and electropneumatic shall be considered non-limiting in the following description.

Conventionally, electropneumatic horns include acoustic units consisting of a straight exponential tube of a length related to the frequency to be reproduced, inserted in an acoustic chamber in which a membrane free to move with a reciprocating motion is arranged and positioned.

Conventionally, the straight tube comprises a first stretch with generally constant cross-section, provided with an inlet mouth for the sound signal generated by the oscillating membrane and a second stretch having a section varying with a generally conic exponential law ending with an outlet mouth for the amplified sound signal (e.g., horn shaped).

As used in these conventional electropneumatic horns, the membrane is properly stretched or positioned during a pre-assembly calibration phase by deformation against the membrane of a member referred to as a 'sound generator' and applied to a chamber body, in such a way to generate a sound with manufacturer-desired predetermined acoustic pressure during a use.

In an alternatively constructed versions of the related art, the acoustic units are paired (commonly bi-tonal), and the corresponding tubes are volute wound and juxtaposed to limit the overall dimensions of the horn allowing for reduced-size installations.

As already stated said acoustic horns and more particularly those with a straight acoustic tube (e.g., 'truck air horns'), equip motor vehicles and are generally installed in the engine compartments and on vehicle roofs.

Acoustic horns with different features are available on the market, both by others and by the present Applicant, and are mainly classified according to the number of acoustic units, generally one to a general maximum of three tuned tonal sounds, each shaped according to the frequency that each unit should reproduce.

The need to optimize space and reduce dimensions of every element of the motor vehicle, has lead to the reduction in size of such electropneumatic acoustic horns generally, and the miniaturization of specific horn components. For example, it is known to reduce the size of the air compressor unit or member as well as reduce the overall size of the acoustic sound units.

Referring now to U.S. Pat. No. 7,038,756 (Di Giovani et al), the entire contents of which are herein incorporated by reference, and FIG. 1 and FIG. 1A, since the earlier proposed solutions had not garnered sufficient success, the '756 patent attempted to respond to the needs in the art by providing a dual tone or dual acoustic unit wherein a completed assembly 1 accommodates dual acoustic units having respective horn openings 4A, 4B within a relatively compact housing 2.

In this related unit, housing 2 contains a single compressor unit or compressor member 6 which is removably and slidably joined within an adjustable clamp to housing 2 and provides a compressed air supply via air supply outlet fixture 13 simultaneously to each acoustic unit within housing 2 via internal chambering.

As also noted dual opposing diaphragm units 3, 3 are shown and respectively receive, via internal chambering (not shown but visible in the '756 patent) compressed air from compressor unit 6 via respective diaphragm air supply portals 16, 16 (the reverse side is not shown). Diaphragm units 3, 3, operate as sound generators and transmit the sound to the volute acoustic chambers respectively connecting each diaphragm unit 3, 3 to respective horn openings 4A, 4B.

Compressor unit 6 consists of an operable motor housing member 14 formed from a very rigid metal body, a bottom electric brush housing member 10, wherein electrical power is received via power supply cords 5, and a top compressor labyrinth member 9. As will be noted from FIG. 1, rigid housing member 14 includes folded metal tabs 15 serving as engagement fingers joining motor housing 14 to top compressor labyrinth member 9 to prevent unintended separation and reliable operation. Typically, bottom electronic brush housing member 10 is secured to rigid housing member 14 via a plurality of removable and accessible snap-in fittings (not shown), allowing ease of assembly. Unfortunately, this ease of assembly also creates relative structural weaknesses in the overall completed assembly 1 that may serve as a source of future failure (as will be discussed).

Housing 2, includes a pair of opposing C-shaped plastic clamp arms 7A, 7B as shown for slidably and removably gripping portions of the external surface of rigid housing member 14. Additionally, an air tube member 11, having an air intake opening 12 is formed along the wall of the first clamp arm 7B and supplies air to a top air opening or inlet (not shown) in compressor to member 9. Additionally, a single mounting bracket member 17, extends rearwardly from compressor unit 6 and compressor pump member 9 allowing attachment to a weather-dry location within an inner vehicle wall mount position (not shown). As noted earlier, system 1 contains a number of relative structural weaknesses, and mounting bracket member 17 a common location for structural failure. As can be recognized from the cantilever construction shown, mounting bracket 17 provides a single-site attachment mechanism, which preferentially fails when used in high-vibration environments, including automotive and motorcycle mounting environments.

Additionally, it shall be recognized by those of skill in the art that opposing paired clamping arms 7A, 7B slidingly receive compressor unit 6, and consequently that even with air outlet fixture 13 providing an additional engagement with housing 2, the construction taught in '576 often results in the mechanical failure causing separation of compressor unit 6 because there is no physical engagement between the body of the compressor unit 6 and housing 2 other than air outlet fixture 13, and because there is no mechanism to maintain the tension between clamp arms 7A, 7B to ensure and maintain a clamping pressure, particularly during the thermal expansion common in plastic housings when employed in high temperature environments common in vehicle wall mounting positions. As a consequence of this tendency for mechanical failure, those who review the mechanical units marked with the '576 patent note the inclusion of an additional adhesive double-tape stick portion 8 between portions of clamp arm members 7A, 7B and portions of the wall surfaces of motor housing 14.

The use of such double-stick tape 8, 8 is unfortunately also problematic since it does not address the initial structural design weakness in the engagement between housing 2 and compressor unit 6, and because such adhesive tape readily fails for a number of reasons, including; (a) degradation, melting, off-gassing, or embrittlement of the adhesive in high temp (>100 Celsius) and low temp (<O Celsius) common in standard vehicle mounting environments or (b) mechanical failure of the tape backing structure itself. Since the related art recognizes the preferred use of unit 1 within the automotive engine cavity, where temperatures routinely exceed 100 Celsius, this thermal and mechanical weakness has resulted in unacceptable failure rates. Since the related art also recognizes the preferred use of unit 1 within the marina and water environments, where chemical reaction with the enhanced humidity and corrosive environment attacks adhesives, this material degradation has resulted in a similarly unacceptable failure rate.

As an additional detriment of the conventional construction discussed, while internal splash baffles (not shown) are discussed in '576 within air intake tube 11, it will be recognized that horn openings 4A, 4B are on the same level with air opening 12 for the compressor air intake, and are not similarly protected due to impact such rigid baffles would have on sound tone and overall sound quality. Therefore, while water penetration within the acoustic tubes via respective horn openings 4A, 4B is no less a danger then water penetration to air inlet tube 11, the related art has not recognized this detriment and has similarly not provided a solution. Consequently, while water-splashing and moisture may readily damage unit 1 via entry to horn openings 4A, 4B even while the unit is within a contained environment, for example an automotive engine cavity, there is an unsatisfied need for substantive improvements in weather and water resistance recognized within the related art. Therefore, there is a need for a weather resistant solution that has minimal or no impact on the generated tonal or sound quality.

Additionally of concern are circumstances wherein the unit is employed as a full replacement for an originally-manufactured horn for a vehicle. Where full replacement use occurs, consumers have no other alternative for emergency use, and consequently the horn must operate at the highest levels of reliability and safety.

What is not appreciated by the prior art therefore, is the need for an improved system comprising a compressor unit and housing member that avoids at least one of the detriments noted earlier so as to provide improved unit operational reliability, as well as operability, minimize mechanical and thermal failures within a wide field of user environments.

Accordingly, there is a need for an improved electric horn system, and more specifically and improved electropneumatic horn system that responds to one of detriments noted above.

OBJECTS AND SUMMARY OF THE INVENTION

An object of the present invention is to provide an electric horn system that overcomes at least one of the detriments noted above.

Another aspect of the present invention is to provide an electric horn system, wherein an electropneumatic horn is provided with an improved and reliable connection between a housing and a compressor unit.

Another aspect of the present invention is to provide an electropneumatic horn system having increased resistance to vibration, thermal challenge, and chemical or environmental/weather related extremes.

Another aspect of the present invention is to provide an improved electropneumatic horn system operable at increased weather, environmental, and temperature extremes.

The present invention relates to an electric horn system includes a monolithic rigid housing member having a receiving opening for fixably housing, in an non-removable and secure manner following assembly, a compressor member, thereby preventing unintended separation and improving a reliability of the electric horn system. An acoustic sound wave generator includes an acoustic duct chambering system associated throughout with the monolithic rigid housing member. The acoustic sound wave generator receives compressed air from the compressor member to produce sound and propagate the same externally. A horn mounting system enables ready attachment of the system to a consumer-desired surface; either mechanically, magnetically, adhesively or via any other known attachment or mounting system. Optional weather and water resistant systems prohibit unintended water access to the electric horn system enabling use of the system in exposed weather conditions for improved user convenience.

The present invention also relates to an electric horn system that allows permanent and irremovable attachment between the monolithic rigid housing member and the compressor member via a series of one-way attachment features preventing unintended separation.

The present system additionally relates to an electric horn system that completely surrounds the compressor member offering protection 360 degrees about an outer periphery of the compressor member.

According to an embodiment of the present invention there is provided an electropneumatic acoustic horn assembly, comprising: an electric compressor unit having at least a compressor air inlet and a compressor air outlet for the supply of compressed air, a sound wave generator system substantially housed in a monolithic housing assembly, the sound wave generator system comprising: at least one acoustic chamber having an opening for the introduction of the pressurized air, a membrane member provided with an opening for sound generation and at least one acoustic duct housed in the monolithic housing assembly and communicating between the at least one acoustic chamber and at least one horn outlet to propagate the sound generated by the membrane member outside the horn, air channeling means for communicating between the compressor air outlet of the electric compressor unit and the opening of the at least one acoustic chamber, means for permanently fixing the electric compressor unit in the monolithic housing assembly of the sound wave generator system, whereby the means for irremovably fixing prevents removal of the electric compressor unit and improves operational reliability of the assembly.

According to another embodiment of the present invention there is provided an electropneumatic acoustic horn assembly, wherein: the monolithic housing assembly includes a monolithic compressor housing portion having a cylindraceous receiving opening, the electric compressor unit being cylindraceous and having a first and opposing second end, the first end of the electric compressor unit being a compressor member, an electrical brush housing portion at the second opposing end, a motor housing joining the electric compressor unit and the electrical brush housing portion, the means for permanently fixing further comprising: spring engagement means for elastically engaging and permanently fixing the cylindraceous electric compressor unit in the cylindraceous receiving opening, thereby improving the reliability of the assembly.

According to another embodiment of the present invention there is provided an electropneumatic acoustic horn assembly, wherein: the cylindraceous receiving opening includes opening side walls, the cylindraceous compressor unit having compressor side walls, the opening side walls and the compressor side walls being juxtaposed with each other upon an assembly of the electropneumatic acoustic horn assembly, and the spring engagement means including at least one spring locking tab member and at least one corresponding locking tab receiving groove, whereby during the assembly of the electropneumatic acoustic horn assembly the at least one spring locking tab urgingly engages the corresponding locking tab receiving groove and prevents removal of the compressor unit from the receiving opening.

According to another embodiment of the present invention there is provided an electropneumatic acoustic horn assembly, wherein: the spring engagement means includes a plurality of the spring locking tab members and a corresponding plurality of the corresponding locking tab receiving grooves, and respective ones of the plurality of tab members and the receiving grooves arrayed about respective ones of the receiving opening and the compressor side walls.

According to another embodiment of the present invention there is provided an electropneumatic acoustic horn assembly, further comprising: means for aligning the cylindraceous compressor unit and the compressor air outlet with the opening in the acoustic chamber for the introduction of the pressurized air, the means including at least one alignment member and at least one alignment groove having complementary shapes for interfitting during the assembly, whereby the alignment member and the groove are slidingly arranged to align the compressor air outlet with the opening.

According to another embodiment of the present invention there is provided an electropneumatic acoustic horn assembly, wherein: the at least one horn outlet includes means for minimizing at least one of a debris and a water entry during a use of the assembly, and the means for minimizing includes at least one selected from a group comprising: an opening seal sealing the at least one horn outlet, at least one flexible louver member flexibly covering the at least one horn outlet, at least one flexible shield member pivotably covering the at least one horn outlet, and at least one of a woven and a metal mesh, whereby the at least one minimizing means enables a release of sound from the at least one horn outlet while minimizing entry of debris and water into the monolithic housing assembly.

According to another embodiment of the present invention there is provided an electropneumatic acoustic horn assembly, further comprising: at least one housing air inlet passage in the monolithic housing assembly, at least one compressor air inlet passage in the monolithic housing assembly communicating from the at least one housing air inlet passage to the compressor air inlet, at least one air inlet including at least one means for minimizing at least one of a debris and a water entry during a use of the assembly, and the means for minimizing includes at least one selected from a group comprising: an opening seal sealing the at least air inlet, at least one flexible louver member flexibly covering the at least one air inlet, at least one flexible shield member pivotably covering the at least one air inlet, and at least one of a woven and a metal mesh covering the at least one air inlet, whereby the at least one minimizing means enables entry of feed air to the electric compressor air unit while minimizing entry of debris and water into the monolithic housing assembly.

According to another embodiment of the present invention there is provided an electropneumatic acoustic horn assembly, further comprising: at least one housing air inlet passage in the monolithic housing assembly, at least one compressor air inlet passage in the monolithic compressor housing portion communicating from the at least one housing air inlet passage to the compressor air inlet, and the means for minimizing includes at least one selected from a group comprising: an opening seal sealing the at least one air inlet, at least one flexible louver member flexibly covering the at least one air inlet, at least one flexible shield member pivotably covering the at least one air inlet, and at least one of a woven and a metal mesh covering the at least one air inlet, whereby the at least one minimizing means enables entry of feed air to the electric compressor air unit while minimizing entry of debris and water into the monolithic housing assembly.

According to another embodiment of the present invention there is provided an electropneumatic acoustic horn assembly, wherein: the at least one housing air inlet passage in the monolithic housing assembly is proximate the electrical brush housing portion at the second opposing end, and the at least one compressor air inlet passage extends from the air inlet passage through the monolithic housing assembly to the compressor air inlet at the first end of the electric compressor unit.

According to another embodiment of the present invention there is provided an electropneumatic acoustic horn assembly, further comprising: means for securing the monolithic housing assembly to an external support member, and the means for securing including at least one selected from the group comprising: a protruding mounting bracket member, a magnetic mounting member, a suction-based mounting member, an adhesive mounting member, and a strap mounting member, whereby the means for securing enables ready attachment of the assembly to the external support member.

According to another embodiment of the present invention there is provided an electropneumatic acoustic horn assembly, comprising: a cylindraceous electric compressor unit having at least a compressor air inlet and a compressor air outlet for the supply of compressed air, and a first and opposing second end, a sound wave generator system substantially housed in a monolithic housing assembly, the monolithic housing assembly having a monolithic compressor housing portion having a cylindraceous receiving opening, the sound wave generator system comprising: at least one acoustic chamber having an opening for the introduction of the pressurized air, a membrane member provided with an opening for sound generation and at least one acoustic duct housed in the monolithic housing assembly and communicating between the at least one acoustic chamber and at least one horn outlet to propagate the sound generated by the membrane member outside the horn, air channeling means for communicating between the compressor air outlet of the electric compressor unit and the opening of the at least one acoustic chamber, means for permanently fixing the electric compressor unit in the monolithic housing assembly of the sound wave generator system, whereby the means for irremovably fixing prevents removal of the electric compressor unit and improves operational reliability of the assembly.

According to another embodiment of the present invention there is provided an electropneumatic acoustic horn assembly, wherein: the first end of the electric compressor unit being a compressor member, a motor housing fixably joining the electric compressor unit, the means for permanently fixing further comprising: spring engagement means for elastically engaging and permanently fixing the cylindraceous electric compressor unit in the cylindraceous receiving opening, thereby improving the reliability of the assembly.

According to another embodiment of the present invention there is provided an electropneumatic acoustic horn assembly, further comprising: an electrical brush housing portion, means for securing the electrical brush housing portion at the second opposing end of the electric compressor unit, and the means for securing the electrical brush housing portion being one of a removable means for securing and a permanent means for securing.

According to another embodiment of the present invention there is provided an electropneumatic acoustic horn assembly, further comprising: means for sealing the electrical brush housing portion to a sealing surface of the monolithic compressor housing portion, whereby the means for sealing minimizes one of a debris and a water entry to the electric compressor unit and improves operational reliability of the assembly.

According to another embodiment of the present invention there is provided an electropneumatic acoustic horn assembly, wherein: the springing engagement means includes a plurality of the springing locking tab members and a corresponding plurality of the corresponding locking tab receiving grooves, and respective ones of the plurality of tab members and the receiving grooves are arrayed about respective ones of the receiving opening and the compressor side walls.

According to another embodiment of the present invention there is provided an electropneumatic acoustic horn assembly, further comprising: means for aligning the cylindraceous compressor unit and the compressor air outlet with the opening inlet in the acoustic chamber for the introduction of the pressurized air, the means including at least one alignment member and at least one alignment groove having complementary shapes for interfitting during the assembly, whereby the alignment member and the groove are slidingly arranged to align the compressor air outlet with the opening.

According to another embodiment of the present invention there is provided an electropneumatic acoustic horn assembly, wherein: the means for permanently fixing the electric compressor unit in the monolithic housing assembly of the sound wave generator system further comprises, at least one of a group comprising: spring engagement means for elastically engaging and permanently fixing the cylindraceous electric compressor unit in the cylindraceous receiving opening, thermal welding means for thermally welding portions of the cylindraceous electric compressor unit with the monolithic compressor housing portion, and adhesively fixing means for adhesively bonding portions of the cylindraceous electric compressor unit with the monolithic compressor housing portion, whereby the means for permanently fixing improves operational reliability of the assembly.

According to another embodiment of the present invention there is provided an electropneumatic acoustic horn assembly, wherein: the at least one horn outlet includes means for minimizing at least one of a debris and a water entry into the horn outlet during a use of the assembly, and the means for minimizing includes at least one selected from a group comprising: an opening seal sealing the at least one horn outlet, at least one flexible louver member flexibly covering the at least one horn outlet, at least one flexible shield member pivotably covering the at least one horn outlet, and at least one of a woven and a metal mesh, whereby the at least one minimizing means enables a release of sound from the at least one horn outlet while minimizing entry of debris and water into the monolithic housing assembly.

According to another embodiment of the present invention there is provided an electropneumatic acoustic horn assembly, further comprising: at least one housing air inlet passage in the monolithic housing assembly, at least one compressor air inlet passage in the monolithic compressor housing portion communicating from the at least one housing air inlet passage to the compressor air inlet, at least one air inlet including at least one means for minimizing at least one of a debris and a water entry during a use of the assembly, and the means for minimizing includes at least one selected from a group comprising: an opening seal sealing the at least one air inlet, at least one flexible louver member flexibly covering the at least one air inlet, at least one flexible shield member pivotably covering the at least one air inlet, and at least one of a woven and a metal mesh covering the at least one air inlet, whereby the at least one minimizing means enables entry of feed air to the electric compressor air unit while minimizing entry of debris and water into the monolithic housing assembly.

According to another embodiment of the present invention there is provided an electropneumatic acoustic horn assembly, further comprising: means for securing the monolithic housing assembly to an external support member, and the means for securing including at least one selected from the group comprising: a protruding mounting bracket member, a magnetic mounting member, a suction-based mounting member, an adhesive mounting member, and a strap mounting member, whereby the means for securing enables ready attachment of the assembly to the external support member.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
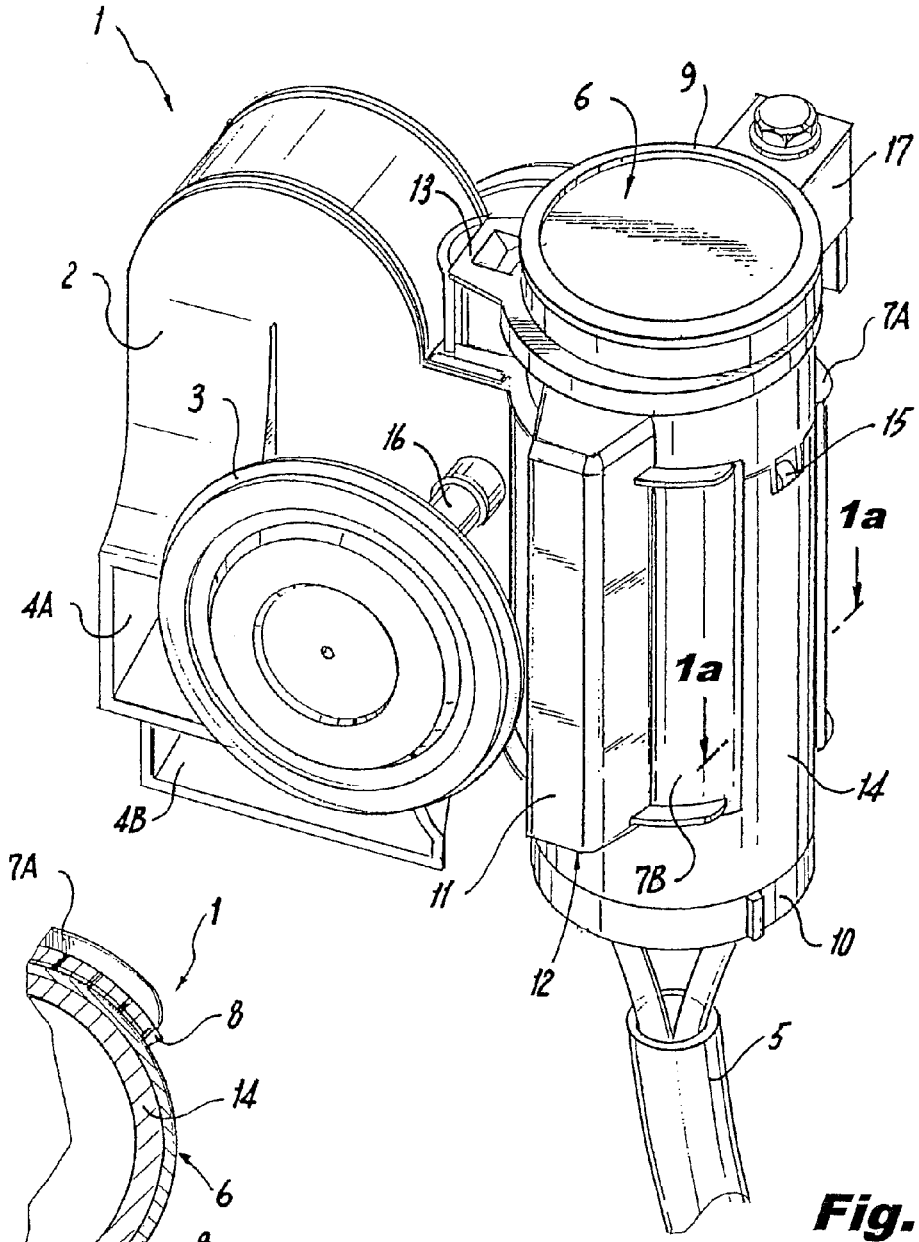
Fig. 1 (Prior Art)
FIG. 1 is a front perspective view of a conventional electropneumatic horn assembly.
Figure 1A:
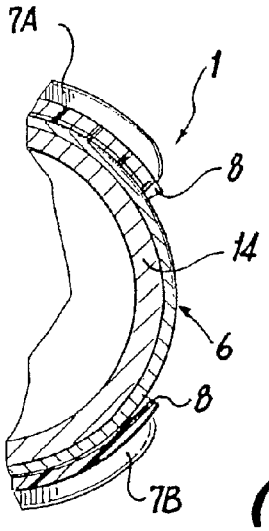
Fig. 1a (Prior Art)
FIG. 1A is a partial cross-sectional view along section line 1A-1A in FIG. 1.
Figure 2:
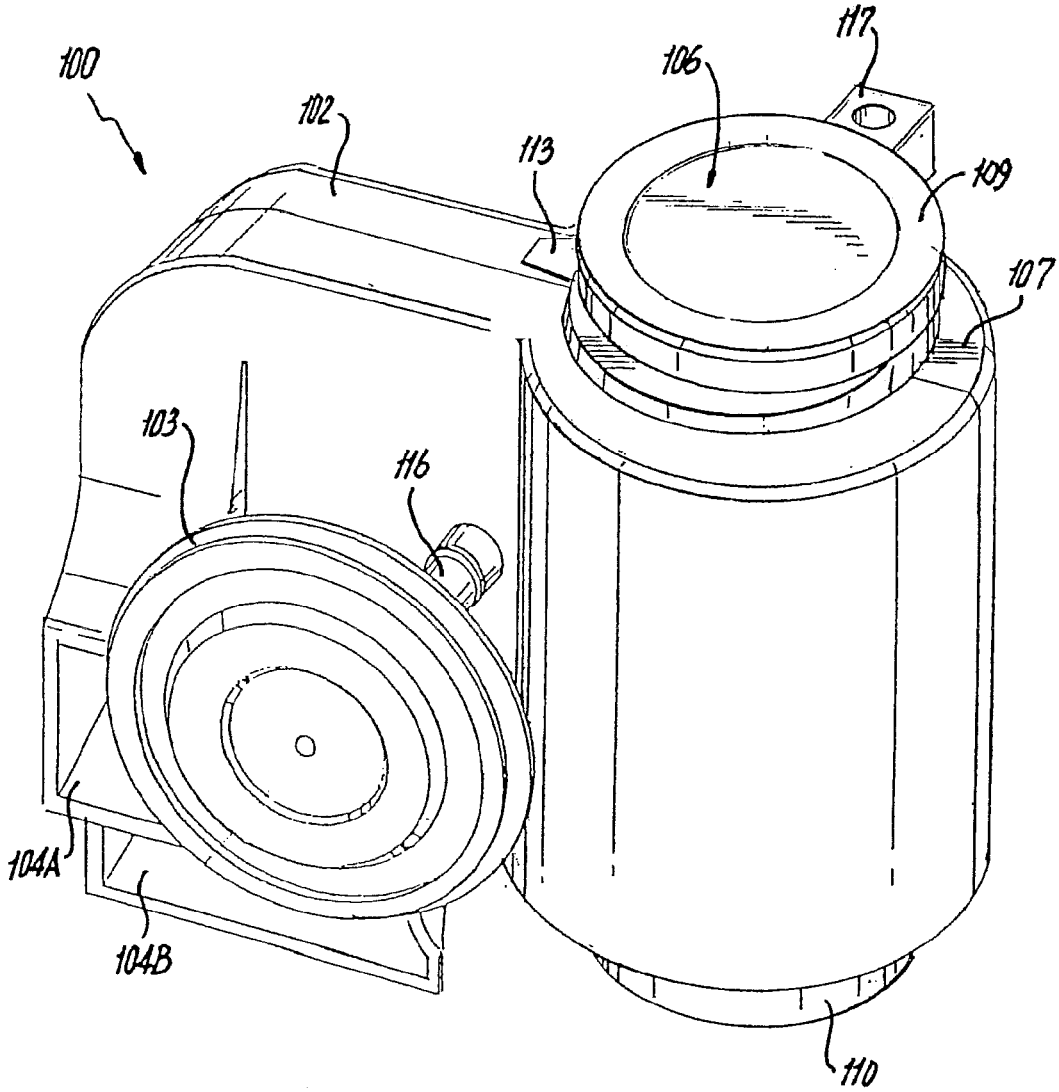
FIG. 2 is a front perspective view of a first embodiment of an electric horn system according to the present invention.
Figure 2A:
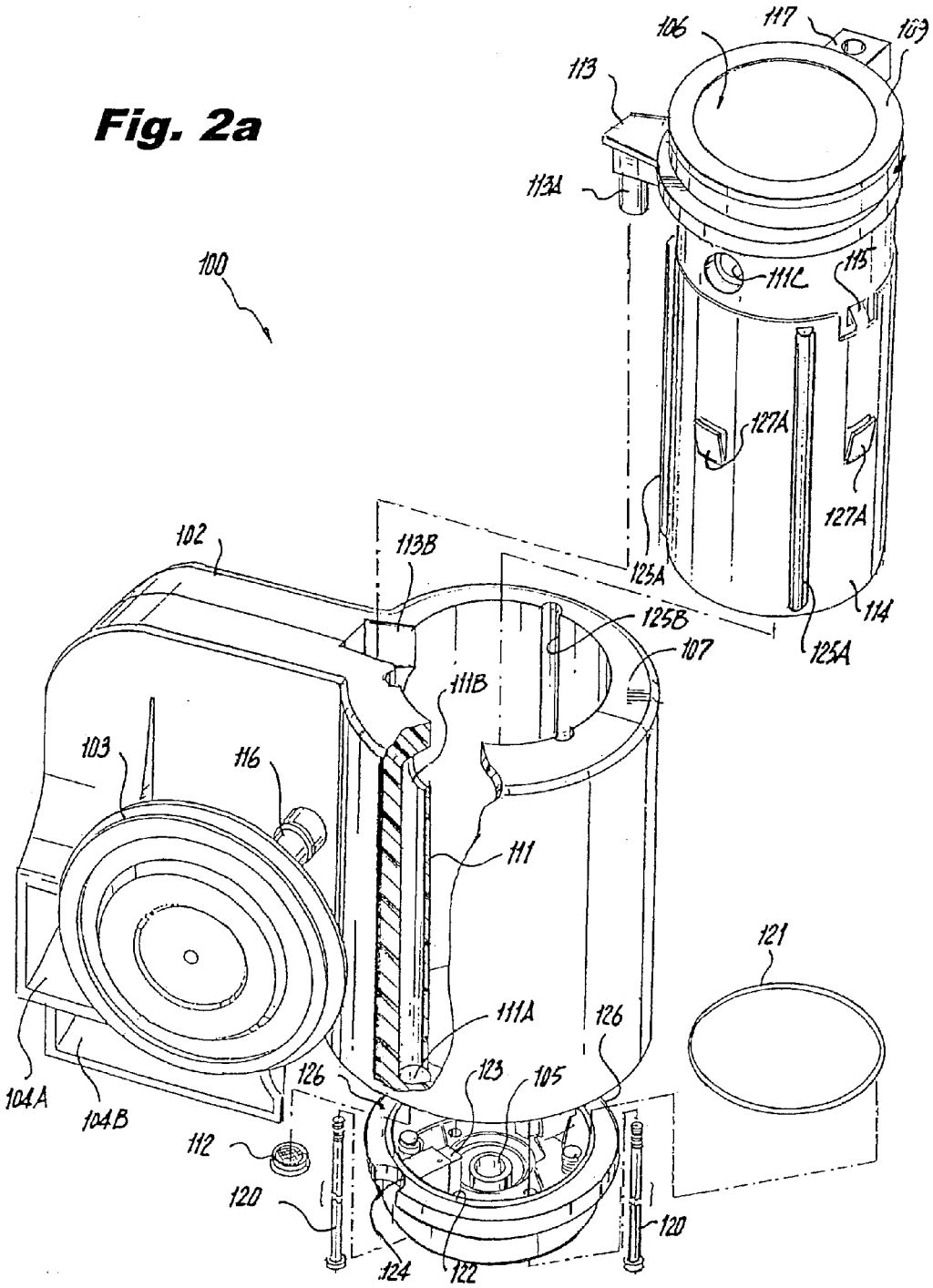
FIG. 2A is an exploded view of the embodiment in FIG. 2.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring now to FIGS. 2, 2A, 3, and 4 an alternative embodiment of an electropneumatic horn has been provided that overcomes at least one of the detriments in the related art noted above.

An electropneumatic horn unit 100 includes a rigid housing unit member 102 having a monolithic compressor housing region 107, and an internally formed dual tonal acoustic ducting system (not shown). The dual tonal acoustic ducting system is similar to that shown in U.S. Pat. No. 7,038,576, and the entire contents of '576 are herein again enclosed again by reference. The dual tone acoustic ducting system receives compressed air exiting a compressed air outlet 113A of an air outlet fixture 113 from a compressor unit 106 (as will be discussed), passes the same via diaphragm members 103, 103 (only one shown) through a diaphragm air supply portal 116 so as to activate the same as sound generators. The sound so generated passes through the dual tone ducting system to exist via respective horn openings 104A, 104B. As will be additionally discussed the tone or sound generation functions of the proposed embodiment are related to those noted in the incorporated '576 patent.

As will be noted from study of the renderings, compressor unit 106 having a bottom positioned brush housing member 110 and an opposing top sided compressor member 109 is completely surrounded by the monolithic body structure of housing unit 102 in the manner depicted. As will be discussed, a rear suspending bracket 117 is rearwardly projected from compressor member 109 in a manner familiar to those of skill in the art, although substantial improvements of this construction are noted in FIGS. 3, 4, and 5, as will be later discussed to secure horn unit 100 to a desired position.

Compressor unit 106 includes an air intake opening 111C proximate compressor member 109 (FIG. 2A), and when compressor unit 106 is operating dispenses compressed air via air outlet fixture 113, as shown. Upon assembly, air outlet fixture 113 nests securely within air outlet receiving block 113B in housing 102 which includes an air intake receiving opening (not shown) for receiving such generated compressed air for horn operation.

As will be noted a motor housing 114 spaces brush housing 110 from compressor member 109 and securely engages compressor pump member 109 via formed bent metal finger members 115 at periodic intervals about a periphery so as to ensure permanent attachment. The motor housing 114 has a metal shell to support metal finger members 115 but also includes optionally both (a) a plurality of orientation or alignment members 125A protruding at regular intervals about a periphery (three are used herein and two are shown), and (b) permanent locking tab member 127A having a hinged end springingly extending from motor housing 114 and ending in a cantilevered spring finger portion (as shown) for engaging and permanently fixing motor housing 114 into housing unit 102, as will be discussed.

An air inlet channel or tube or passage 111 is internally positioned within a wall member of monolithic housing member 102, and extends from a bottom air inlet opening 111A to a top air exit opening 111B aligned and in communication with air inlet 111C after unit assembly. An air inlet screen member 112 is fixably positioned in air inlet 111A and being preferably of a fine mesh construction prohibits water entry by physical blockage and capillary forces while simultaneously enabling a full flow of air to enter compressor unit 106.

Brush housing 110 is formed as a fixable cap member and includes a central self-lubricating bearing or bushing member 105 allowing passage of electrical power to respective brushes 123, 123 (only one shown). While brush housing 110 is formed for receipt of wires, it will be recognized by those of skill in the art that alternative constructions to allow electrical connection to respective brushes 123 may be achieved without departing from the scope of the present invention. For example, an electrical connection to respective brushes 123, 123 may be achieved employing solid state copper electrical fingers (not shown) projecting from a bottom portion of brush housing 110 and engaging respective electric finger members (not shown) crimped on the end of respective electrical wires (not shown), all without departing from the scope and spirit of the present invention.

As depicted, brush housing 110 has a peripheral extending lip member 122, having a thickness 126 and projecting outwardly sufficiently to engage the bottom surface of monolithic housing member 107 and to form a weather tight seal thereto. As an additional safety factor, extending lip member 122 may optionally include a sealing O-ring channel (not shown) and a flexible elastomeric O-ring 121 to prohibit water entry. An optional cut lip region 124 is shown such as to prohibit lip member 122 from blocking air access to air opening 111A. It will be recognized, that alternative constructions may be envisioned without departing from the scope and spirit of the present invention, including those without a lip region 124 and with alternative sealing mechanisms, such as the use of liquid sealants and mechanical friction seals.

A pair of locking screws 120, 120 pass through brush housing member 110 to engage openings in motor housing 114 and engage and lock with threaded holes on an underside surface (not shown) internal to compressor pump member

109, thereby fixedly securing brush housing member 110 into compressor unit 106, sealing brush housing 110 to the bottom surface of monolithic compressor housing portion 107, and drawing and urging compressor unit 106 fully into housing 102 to fully engage locking tabs 127A in respective locking engagement openings 128B (see FIG. 3) formed in the rigid wall of monolithic housing member 107, as will be discussed.

A particular advantage of the proposed construction is that locking tabs 127A and corresponding locking grooves 128A provide an initial stage of permanently fixing compressor member 106 in housing unit 102. As an important secondary advantage it must be recognized that the present construction involving sealing brush housing 110 and locking screws 120 provides a second mechanism or system for securing and permanently fixing compressor unit 106 in position by actually urging a secure positioning and compressing or drawing-tightly of the compressor member 109 to the top side of housing unit 120 while simultaneously drawing brush pump housing 110 upwardly to the bottom side of housing unit 120 and sealing lip member 122 to the bottom surface thereby also ensuring complete installation of locking tabs/grooves 127/128 while improving weather resistance and preventing moisture entry. As a consequence, it will be recognized that the proposed invention adds multiple forms of permanently fixing that operate in distinctly different but complementary manners to achieve the desires of the proposed invention and provide a distinct advantage during manufacturing.

During assembly of the present preferred embodiment, it is envisioned that housing unit 102, with monolithic housing member 107 is secured in position and a operator or machine grips a pre-assembled motor housing 114 and compressor 109 (fixed together by fixing fingers 115). The operator then orients compressor 109 so that air outlet fixture 113 is oriented to be fittingly received within air outlet receiving block 113B and initially engages the bottom of motor housing 114 in the opening in monolithic housing member 107. While not required for the invention, and as an additional benefit, the motor housing 114 shown includes a plurality of alignment members 125A that mesh with a plurality of pre-formed alignment slots 125B formed on an inner wall of the compressor opening to aid and secure alignment.

As will be appreciated from the figures, while only a single pair of alignment member 125A and alignment slot 125B may be employed, the present embodiment includes a plurality of the same arrayed about the opening in monolithic housing 107 for improved security and eased assembly. In this way, the present invention enable swift and secure alignment during an assembly and minimizes a risk of unintended damage by contacting air outlet fixture 113 with the top surface of monolithic housing 107. It is note that such unintended contact is a common assembly problem with the related art represented by U.S. Pat. No. 7,038,576, and results in quality control losses during assembly.

As will be additionally appreciated from the figures, receiving openings 128A are formed within the inner side wall of the receiving opening of monolithic housing member 107 at pre-determined intervals to receive respective spring engaging and fixing member fingers 127A. With the above-noted aid to alignment, locating specific pairs of fingers 127A/openings 128A is eased and simplified because there is no need, and indeed no ability, to rotate motor housing 114 relative to monolithic housing 107 after initial alignment. It is respectfully noted, that the receiving opening in monolithic housing 107 is shaped to snuggly fit the outer perimeter surface of the assembled motor housing 114 and compressor pump member 109 so as to allow secure engagement with fingers/holes 127A/127A as a permanent fixing mechanism preventing the removal of motor housing 114 (and the compressor unit 106) following initial assembly. It is additionally noted, in FIG. 4, that an alternative fixing mechanism may be employed, wherein, projecting spring engaging fingers 127B project from the inner side wall of the monolithic housing 107 and are lockingly received in respective engaging openings 128B formed in the outer periphery of motor housing 114 as shown. In this way, the present invention envisions a plurality of single use locking mechanisms that enable an initial assembly between monolithic housing 107 and compressor unit 106 and that prevent the possibility of removal thereafter, thereby removing the risk of unintended separation.

As will be additionally noted from the Figures, an outer projecting rim of compressor member 109, shown on a proximate level with air outlet fixture 113 is firmly fixed to the top surface of monolithic housing member 107.

As a consequence, the present embodiment it is noted, that during an assembly, the sub-combination of motor housing 114 and compressor member 109 are pre-assembled and then aligned, inserted, and fixably and non-removably locked in position within monolithic housing such that the outer projecting of compressor member 109 seals the same to the top surface of monolithic housing member 107. It is noted that any form of additional seal may be employed, such as an O-ring or sealing caulk, to improve the seal between the outer projecting rim and the monolithic housing member 107. It is envisioned that where such an O-ring is employed for sealing, a complementary O-ring groove or opening may be additionally employed to secure the O-ring in position. Such an O-ring groove may be on the brush housing lip 122, on the top or bottom of monolithic housing member 107, and on the projecting rim of compressor member 109, without departing from the scope and spirit of the present invention.

Following installation of the sub-combination, the sealing member (O-ring shown) is positioned on the outer locking flange of the brush housing member 110 and locking screws 120 are inserted and tightened, fully sealing brush housing member 110 to compressor unit 106 and serving to apply a sealing tension on opposing sides of monolithic housing member 107 to improve unit reliability and manufacturing quality by preventing vibratory separation, temperature change damage, and the other detriments causing concern in the related art.

While the present embodiments contemplate the use of opposing spring fingers and receiving openings for allowing a form of single-use locking engagement during insertion, nothing herein shall so limit the invention. Those of skill in the art will appreciate that alternative locking mechanisms, assemblies, or elements may be employed without departing from the spirit and scope of the present invention. For example, permanently fixing compressor unit 106 in monolithic housing member 107 may be achieved additionally by the use of (a) locking high-durability adhesives, (b) thermal welding of plastic portions, (c) threaded-use-failure members (that thread in to a threaded path and lock in-place), (d) the use of pivot-locking members much as swing or pivot arms within either monolithic housing member 107/motor housing 114 which engage after insertion to fixably position compressor unit 106, and (e) other cam or key-way type engagements where a cam or key member are inserted between the monolithic housing unit 107 wall and motor housing 114, since all such adaptive fixing mechanisms are known to those of skill in related arts and may be adapted as required to fulfill this goal.

Figure 3:
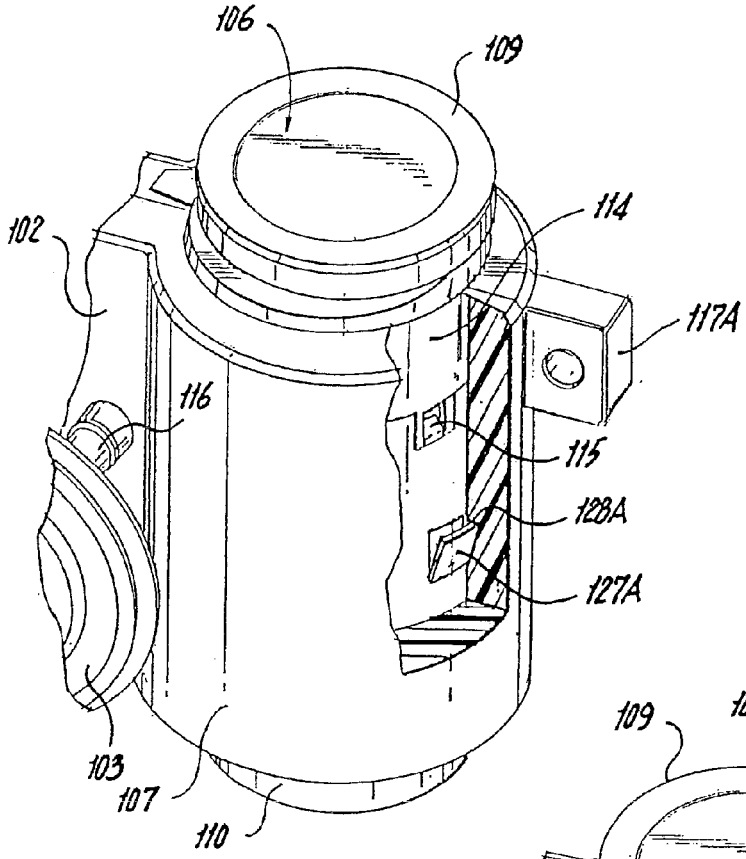
FIG. 3 is a partial sectional perspective view of a wall section assembly of the embodiment in FIG. 2.
Figure 4:
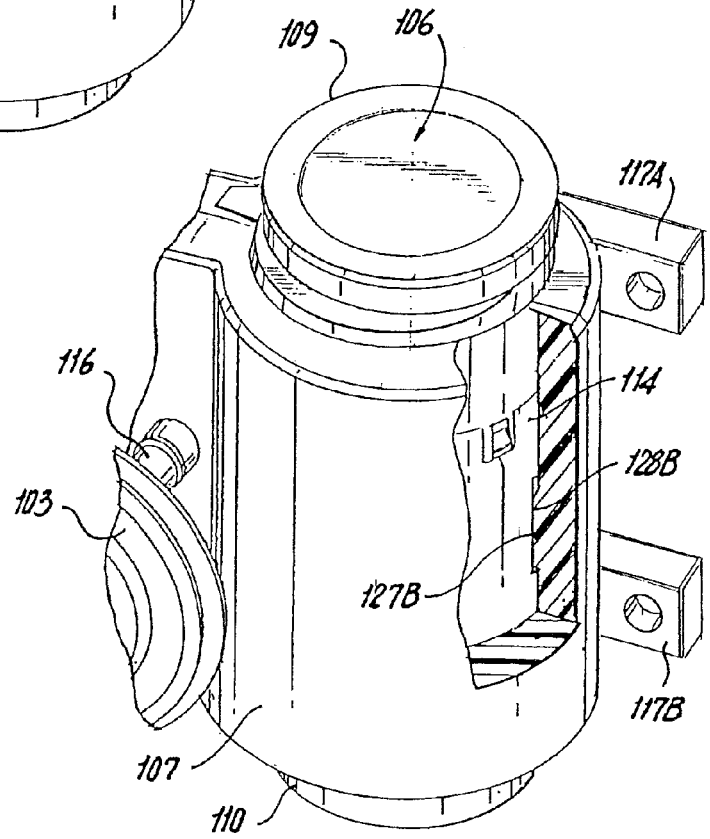
FIG. 4 is a partial sectional view of an alternative engagement feature between a compressor unit and the monolithic housing.

Referring specifically now to FIGS. 3 and 4, alternative forms of the mounting bracket are shown, this time extending from monolithic housing member 107 as mounting members or blocks 117A (on a top side), and optionally as a pair with a block 117B at a bottom portion. As will be appreciated by those of skill in the art, the present invention repositions the housing blocks to the much stronger housing unit member 102 generally, and extends multiple mounting points to prohibit breakage due to the excessive vibration from compressor unit 106.

While the present embodiment provides such mounting members or blocks 117A, 117B, it is additionally envisioned that alternative mounting systems may be employed without departing from the scope and spirit of the present invention. To this end, the present invention contemplates the use of magnetic, adhesive, and buckle and strap-type mounting systems. Regarding magnetic mounting system, it is envisioned that monolithic housing unit 102 may be readily molded and formed to receive a flush-mounted inset magnet or a series of flush-mounted or other magnetic members on a rear-attachment surface thereof. Employing such a magnetic mounting system it is envisioned that unit 100 may be readily positioned and secured in place on a magnetic or paramagnetic surface, such as a mounting wall within an automotive engine compartment. Regarding an adhesive mounting system, it is envisioned that, similarly to the magnetic mounting system, the molded monolithic block 102 be formed with planar faces on a rear or side surface thereof such that a high temperature or thermal welding adhesive may readily permanently fix unit 102 to any selected mounting surface. In combination with any of the above mounting systems, or alone, a buckle and strap-type mounting system is envisioned wherein rigid strap ridges and built in strap mounting arms are formed permanently in the monolithic housing member 102, thereby allowing unit 100 to be strapped and fixed to a bar, beam, flat surface, or other structure element so as to prevent unintended removal.

As an additional benefit of the present invention, it is envisioned that horn openings 104A, 104B may be additionally made weather resistant by the use of Gortex type flexible shutters sealing each opening from moisture and dirt incursion so as to prevent the horn's premature failure in a wet or dirty operating environments while at the same time allowing the horn to produce the regular powerful tonal sound (limited if any decrease in sound performance). Such a shutter may be viewed as a single sealing piece of flexible material sealed over the opening but allowing vibration passage, a series of draping folds of similar material that drape closed under the force of gravity when not in use and spread open to allow sound release during a use, or a single draping fold on a hinged arm allowing only one-way sound exit while preventing inward entry of water and debris to the horn's sound chambers. Those of skill in the art will also recognize that such a similar piece of sealing substantially waterproof or water resistant material may be provided for air intake opening 111A or 111C to prevent related damage to compressor unit 106. In all, those of skill in the art of product design will recognize that the use of such systems will virtually render the entire horn as waterproof, and certainly water proof for periodic splashes or immersion due to splashing when installed in an automobile, on a motorcycle, on a boat, or other vehicle.

Figure 5:
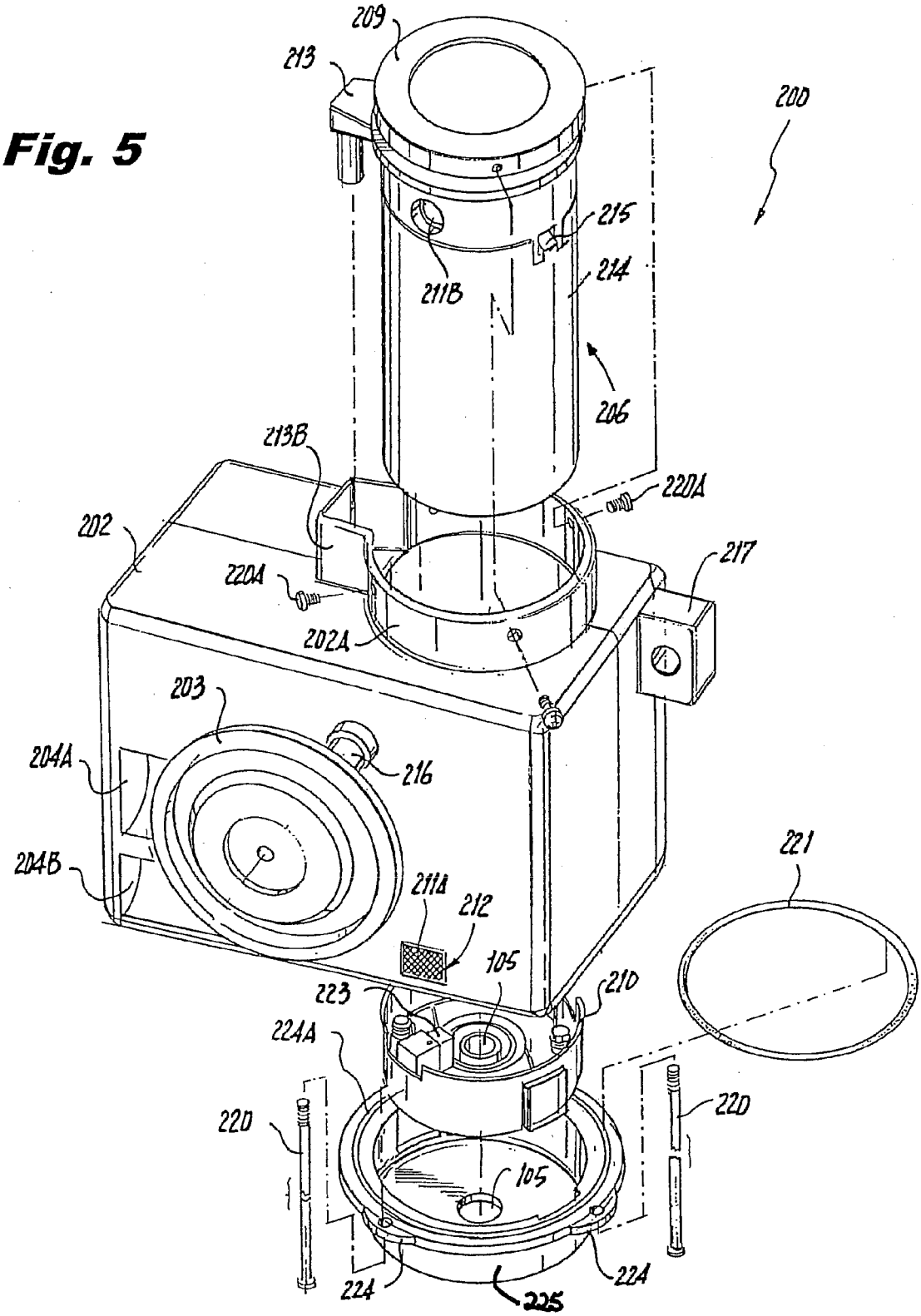
FIG. 5 is an exploded perspective view of a second alternative embodiment of an electric horn system according to the present invention.

Referring now to FIG. 5, an alternative embodiment of a monolithic electropneumatic sound generator unit 200 is noted, and comprises a monolithic housing block member 202 for receiving a partially assembled compressor unit 206, as shown.

As noted from examining the figure, the entire acoustic tonal generator is, as was noted above, internal to monolithic housing block member 202 and operates via received compressed air from compressed air outlet fixture 213 (when inserted into protective air outlet receiving block 213B) through respective internal tonal chambers passed diaphragm air supply ports 216, 216 (only one shown) and respective diaphragm units 203, 203 (only one shown) to generate sound which then is conducted via the remainder portions of respective internal tonal chambers to respective horn openings 204A, 204B for exit to the atmosphere. It is noted that constructions for the internal acoustic tonal passageway internal to the monolithic block are well known to the art and are generically represented by U.S. Pat. No. 7,038,576, the entire contents of which are again herein incorporated by reference, and it is only the external appearance of monolithic housing member 202 which is improved according to the present invention.

As noted earlier, compressor unit 206 includes a metallic motor housing portion 214 that is fixed to compressor member 209 as a first installation member or assembly, and is later assembled with a bottom brush housing member 210, as will be discussed for permanently mounting into monolithic housing block member 202.

As will be noted, a protective fixing skirt 220A extends upwardly from the top surface of monolithic housing block member 202 and is shaped to fixably receive the first installation member as shown. A plurality of outer locking openings (shown but not numbered) in fixing skirt 202A receive respective fixing bolts 220A which engage and fixably seal with threaded openings in the top extending flange from compressor member 209 (as shown). In this manner, during assembly the first installation member or assembly is oriented to align air intake opening 211B with an internal air channel outlet (not shown which extends from an external air intake opening 211A protected by a protective screening member 212), and to align air outlet fixture 213 with air outlet receiving block portion 213B. The installation member or assembly is then inserted into monolithic housing member 202 (as shown).

At this point either fixing members, the fixing bolts 220A are inserted and fixed into the outer flange of compressor member 209 to fix the member in place, and/or additional locking members are employed (such as the locking tabs/openings noted in the earlier embodiment), to permanently fix the first installation member of compressor 206 in position. It shall be recognized, that while the present embodiment discloses only one fixing option (fixing bolts 220A), that alternative and different fixing mechanisms may be used to permanently retain the first installation member or assembly (compressor member 209 and motor housing 214), and prevent it's removal following such assembly without departing from the spirit and scope of the present invention.

Thereafter, brush housing member 210, having respective brushes 223 and bearing member 105 is positioned in a bottom of the receiving opening in monolithic housing member 202, and permanent locking tabs (not shown) are lockingly inserted in respective receiving slots in the bottom side of housing member 202. Thereafter, a bottom sealing cap member 225 having a respective outer flange and periphery mounting portions 224 is positioned, sealing O-ring member 221 is also positioned in O-ring groove 224A, and respective locking bolt members 220 are inserted and locked in place fixing bottom sealing cap member 225 in position. As noted in the figure, a bearing pocket 105', or bearing seal, 105' enables the rotational end of the axle of motor housing 214 to extend through (if optionally needed) bearing 105 and still be covered by cap member 225 for a weather resistant seal (for example pocket or seal 105' may be formed as a concave receiver retaining the pivoting end of the motor axle. As a consequence of this construction, it will be recognized that the present proposed assembly 220 is formed to receive and permanently fix compressor unit 206 in position following such assembly, and to prevent removal by a variety of mechanisms.

It will be recognized, that sealing O-ring member 221 and O-ring groove 224A represent only one of a plurality of ways of sealing and protecting brush housing member 210 from weather encroachment. It will also be appreciated, that alternative constructions may seal bearing 105 in respective housing 210, and also that cap member 225 may be replace with an alternative construction that allows a sealed electrical connection to the brushes without departing from the scope and spirit of the present invention. Such sealed electrical connections are known to those of skill in the consumer electronic arts, and may optionally include extending contact blades of copper that receive external electrical connection through cap 225. Consequently, while power supply openings 105 may be readily sealed in ways known to those of skill in the art, other sealing designs shall be considered to be within the scope of the present disclosure.

Additionally, it is envisioned that a top compressor member sealing system (not shown) may be employed to provide a weather resistant cover (not shown) to the top of compressor member 209 following installation. Such a weather resistant cover may be formed with an expanding top flange and O-ring assembly (not shown), an external rubber cap may be sealed about skirt member 202A, or a sealing and fixing epoxy may be poured within and over skirt member 202A to both seal and fix the first assembly member of compressor assembly 206 in place.

It will also be appreciated by those of skill in the art that the present assembly overcomes at least one of the detriments noted in the related art and provides a rigid and secure mounting between the acoustic generation portion of the electropneumatic horn assembly and the compressor portion, thereby improving reliability. To this aid, attachment flanges 217 extend from portions of monolithic housing block 202 (one is shown) to enable easy fixing in place. Such attachment flanges 217 may be readily positioned elsewhere on monolithic housing, or replaced with any of the other mounting constructions noted herein, without departing from the spirit and scope of the present invention.

As noted earlier, the present embodiment enables sealing of the compressor unit 206 assembly openings on the top and bottom portions of the monolithic housing assembly 202. As an additional benefit sealing screen 212 resists water and debris uptake while allowing air-passage. Similarly, the present embodiment of the electropneumatic horn assembly 200 may include the other optional sealing matters discussed above without departing from the scope and spirit of the present invention. For example, sealing Gortex shutters may provide one-way exit flow from horn openings 204A, 204B, sealing diaphragms may cover the openings, or other water and debris resistant covers may seal horn openings without departing from the scope and spirit of the present invention. In this manner, those of skill in the art will recognize that alternative and adaptive constructions may render the present embodiment substantially weather resistant and allow for adaptive installation in weather-exposure environments as an improvement of the related art.

Figures 6, 6A, 6B:
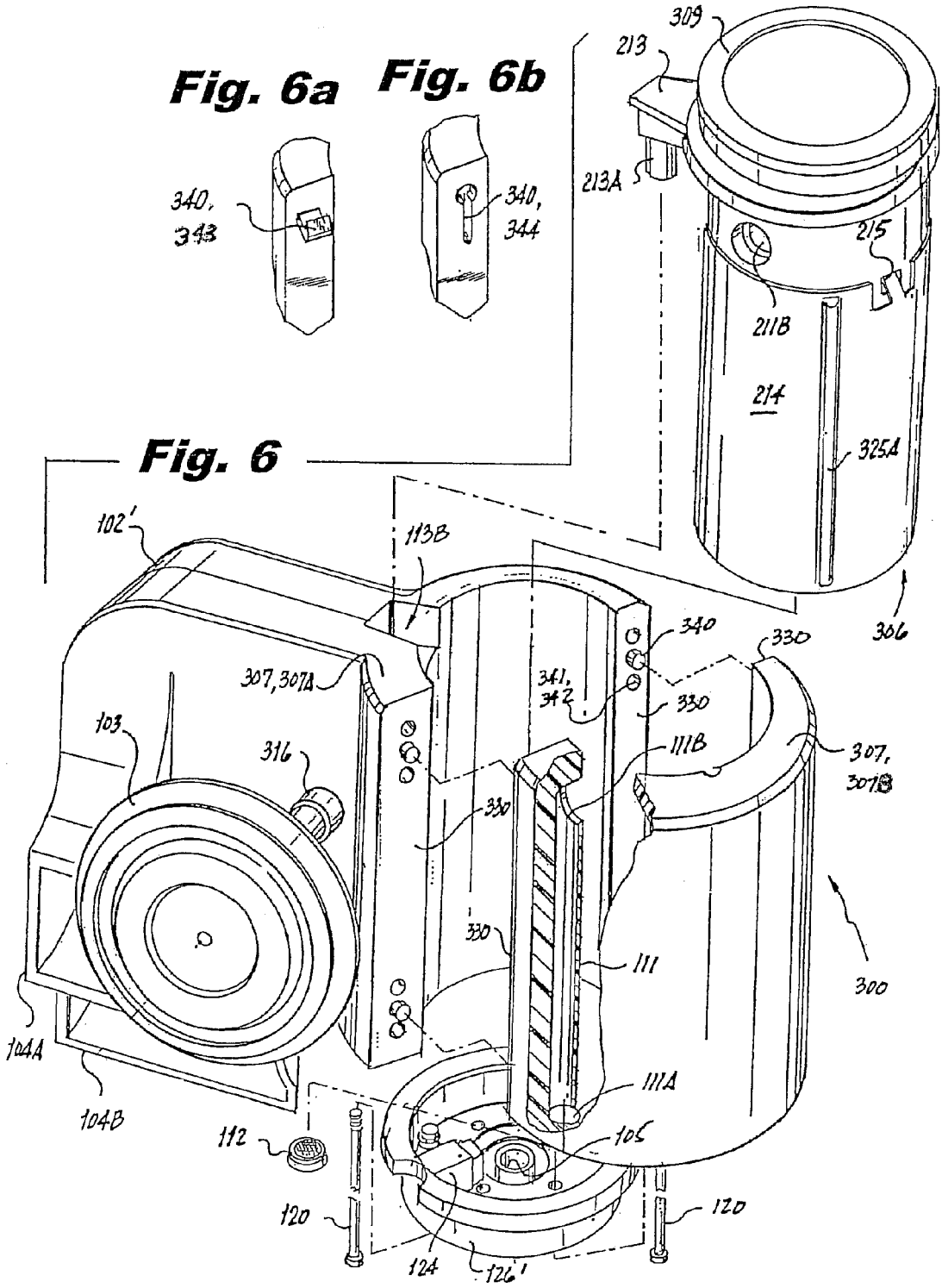
FIG. 6 is an exploded perspective view of a third alternative embodiment of an electric horn system according to the present invention.
FIGS. 6A, 6B are close up views of alternative alignment means between the bonding surfaces noted in FIG. 6.

Referring additionally now to FIGS. 6, 6A, and 6B a third electropneumatic horn unit 300 includes a divided rigid housing unit member 102' having a divided monolithic compressor housing region 307A, 307B, as shown, and an internally formed dual tonal acoustic ducting system (not shown). The dual tonal acoustic ducting system is similar to that shown in U.S. Pat. No. 7,038,576, and the entire contents of '576 are herein again enclosed again by reference. The dual tone acoustic ducting system receives compressed air exiting a compressed air outlet 213A of an air outlet fixture 213 from a compressor unit 306 (as will be discussed), passes the same via diaphragm members 103, 103 (only one shown) through respective diaphragm air supply portals 316 so as to activate the same as sound generators. The sound so generated passes through the dual tone ducting system to exist via respective horn openings 104A, 104B. As will be additionally discussed the tone or sound generation functions of the proposed embodiment are related to those noted in the incorporated '576 patent.

As will be noted from study of the renderings, compressor unit 306 having a bottom positioned brush housing member 126' and an opposing top sided compressor member 309 is completely surrounded by the monolithic body structure of housing unit 102' in the manner depicted. As was discussed in the earlier embodiments, a rear suspending bracket (not shown) is rearwardly projected from compressor member 309 in a manner familiar to those of skill in the art, although substantial improvements of this construction are noted in FIGS. 3, 4, and 5, as will be later discussed to secure horn unit 300 to a desired position following assembly.

As will be particularly noted here, housing unit 102' and particularly compressor housing portion 307, containing portions 307A and 307B are initially separable but include pairs of opposing bonding walls 330, 330 which following assembly as noted are thermally welded to each other to permanently and fixably bond portions 307A, 307B in an inseparable manner. Also on opposing bonding walls 330, 330 are a respective series of alignment systems 340, as shown in FIGS. 6, 6A, and 6B. Alignment systems 340 may optionally include a series of extending pins and holes, respectably 341, 342, engagement spring clips 343 and slots (only spring clips shown in FIG. 6A, and alignment and engagement slip ways 344 engaging opposing alignment pins (not shown) on an opposing bonding wall 330.

As will be readily apparent to one of skill in the art having reviewed the present disclosure, during an assembly, compressor 306 is placed within the first ark shape of housing portion 307A, as shown and aligned employing a series of alignment protuberances 325 on the compressor outer wall (as shown). Thereafter, the opposing arc portion of housing portion 307B is positioned and aligned employing any of the alignment systems 340 shown, or any of those understood to those of skill in the art having appreciated the present disclosure, so that opposing bonding walls 330, 330 are in contact along their bonding surfaces. Thereafter, a thermal or radiant bonding is applied along the ranges of bonding walls 330, 330 so as to permanently fix them in position and render compressor unit 306 completely fixed in position within housing 102'. Thereafter, as discussed above, bottom brush housing member 126' is fixably positioned to complete assembly and provide a second locking system to fixably retain compressor unit 306.

A fourth embodiment of electropneumatic horn unit 400 is characterized by the compressor unit part 406 being mounted fixedly permanently to the monolithic mounting housing, this embodiment having enhanced operational reliability which contributes to an especially longer service life.

Figure 7:
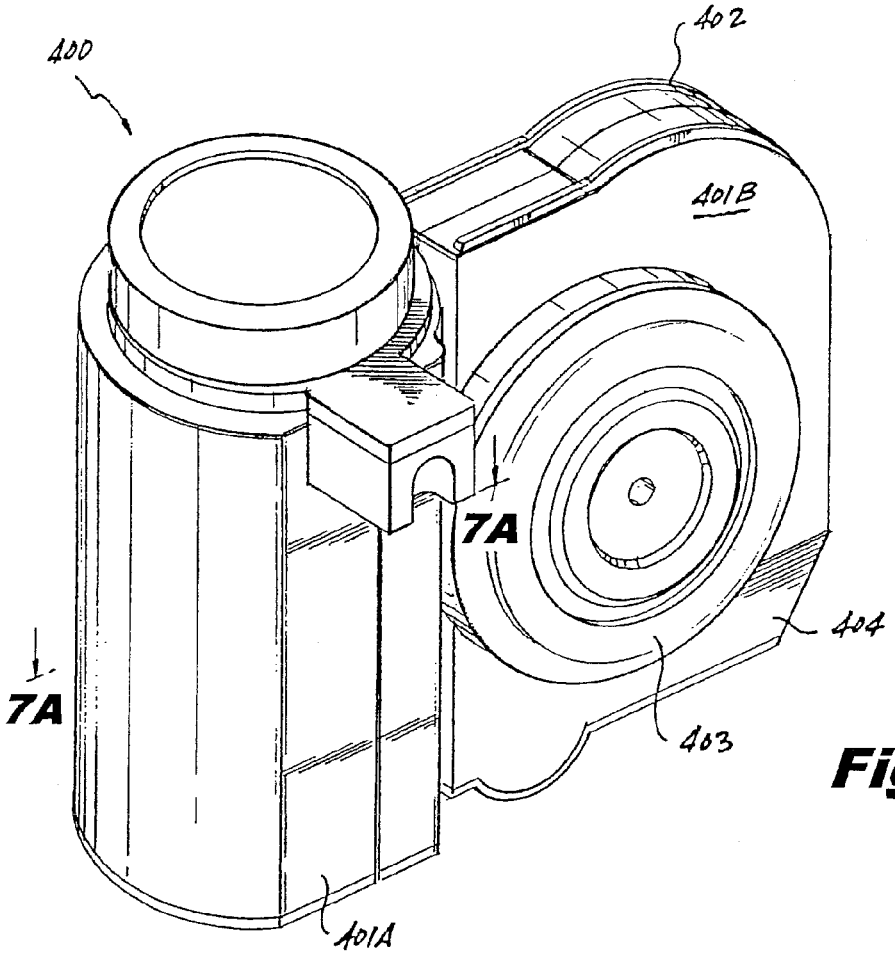
FIG. 7 is a front perspective view of a fourth embodiment of an electric horn system according to the present invention.
Figure 7A:
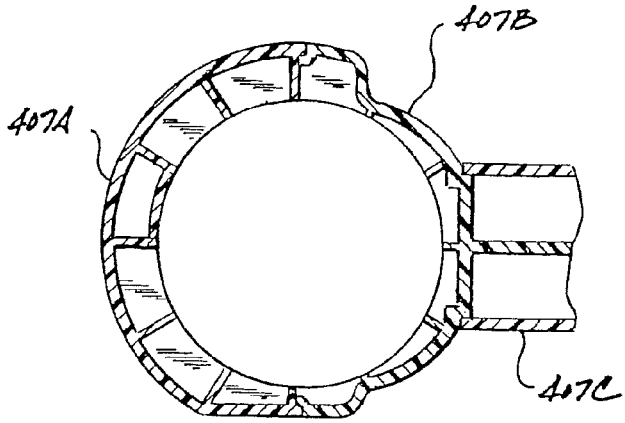
FIG. 7A is a sectional view taken along the line 7A-&B in FIG. 7.
Figure 8:
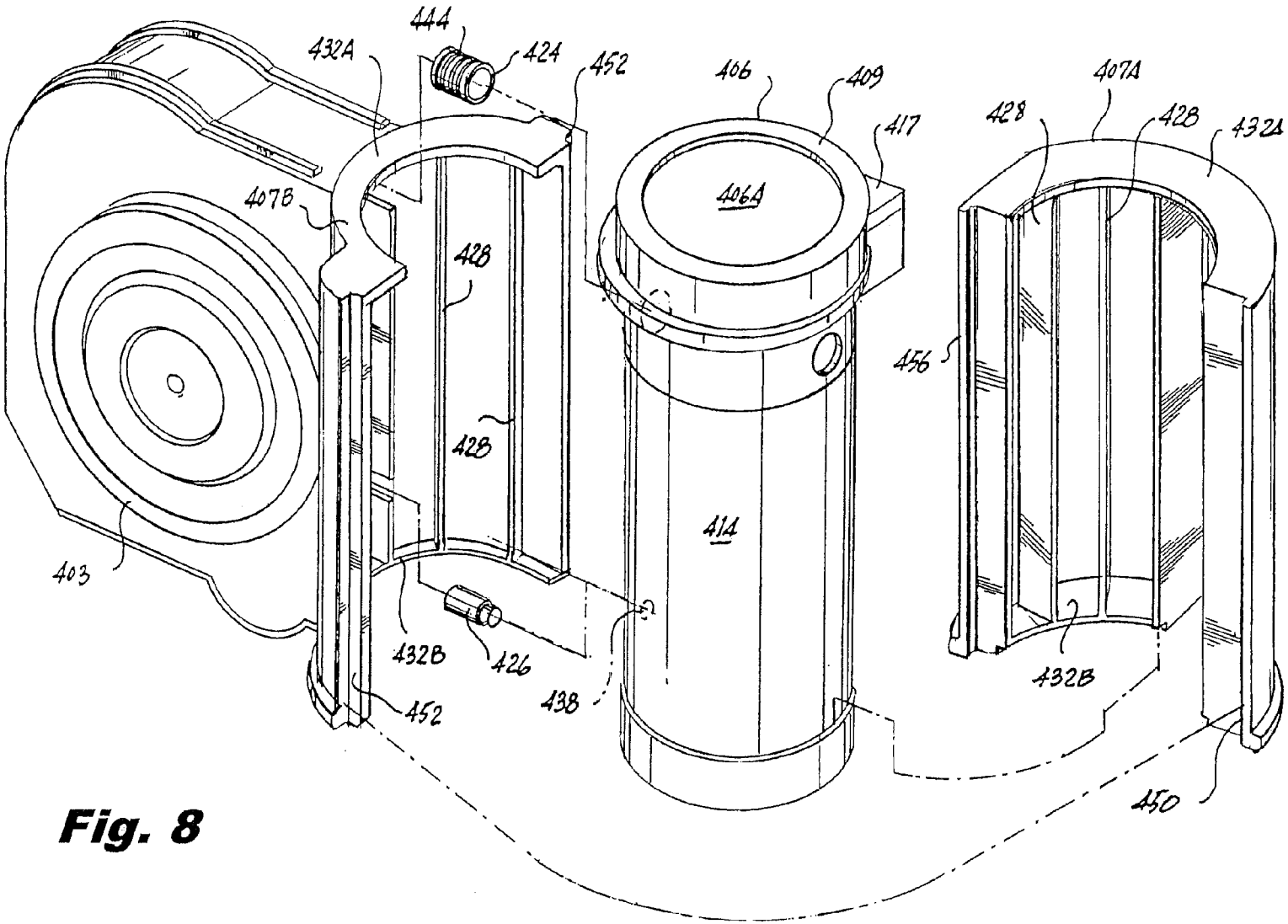
FIG. 8 is an exploded perspective view of the FIG. 7 embodiment.

Referring to FIGS. 7 and 8, horn unit 400 includes a monolithic housing 402 comprised of an assembly 402 having first and second housing portions 401A, 401B. These two portions includes housing parts 407A, 407B and 407C—seen in FIG. 8 before assembly together. In the assembly as depicted in FIG. 7, the parti-circular housing parts 407A and 407B which comprise the housing first portion, are joined in girding encirclement of compressor unit 406, being permanently joinable together along opposite end edges of each housing part. Housing part 407C serves for mounting diaphragm 403 and constitutes the second housing portion 401B. Housing part 407C is permanently affixed to housing part 407B. A horn opening 404 is provided at a front face of housing part 407C. In the assembly, housing parts 407A, 407B include an opening which defines a cylindraceous reception space for receiving the cylindraceous outer periphery configured electric compressor unit 406. A block 417 for mounting the assembly in use, such as on a vehicle firewall, is carried by and extends outwardly from an upper part of the compressor unit 406.

Figure 9:
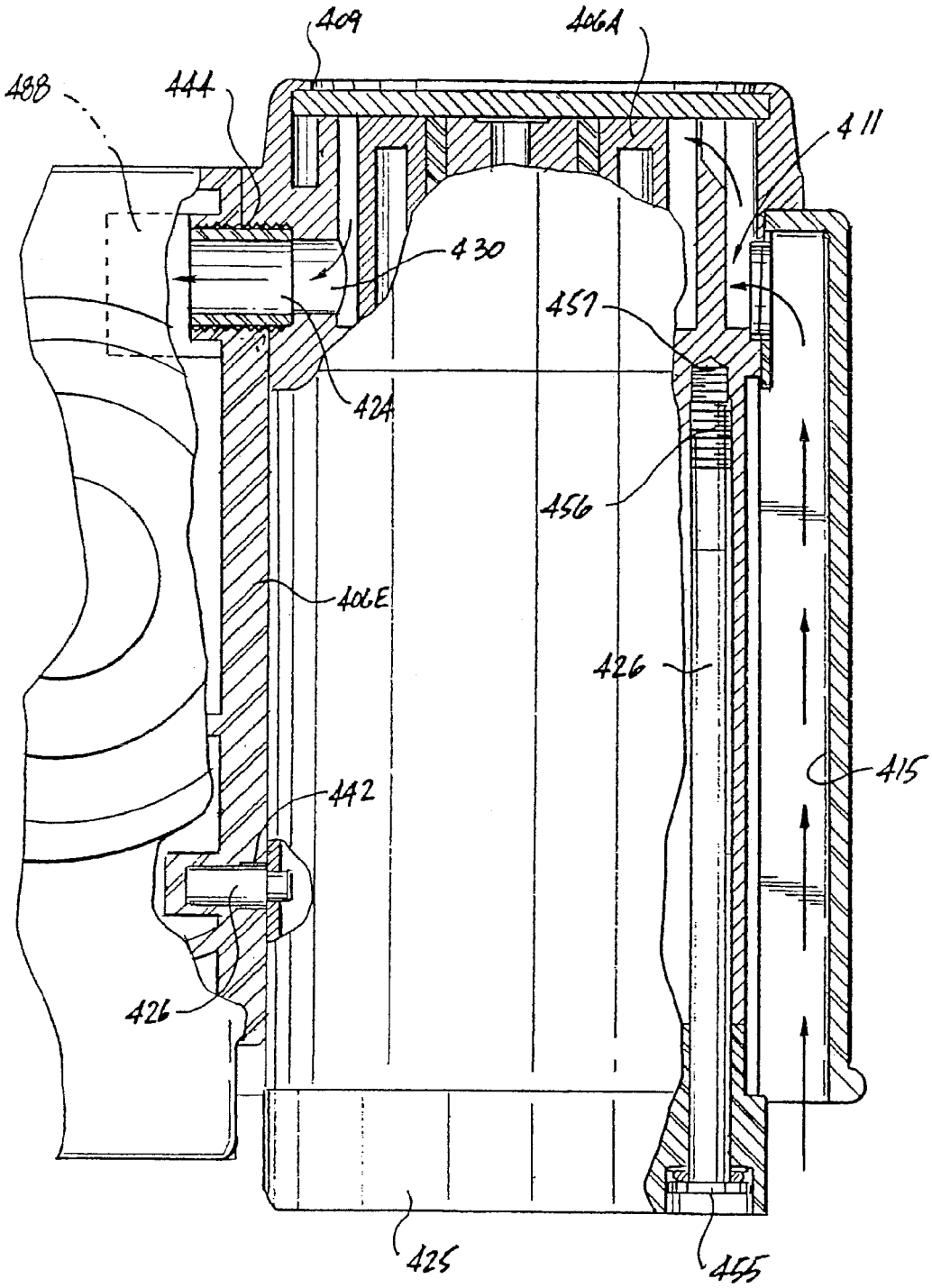
FIG. 9 is a partial view partly in section of the FIG. 7 embodiment depicting the compressor unit mounting to the monolithic housing.

Referring to FIGS. 8 and 9, compressor unit 406 includes a top side part 409 which houses compressor pump member 406A, air intake to which is taken from outside environment through air inlet passage 415 and passes into the pump member through an air inlet 411 thereof, pressurized air outletting the pump member by way of outlet 430. Outlet 430 communicates with a first end of tubular member 424 that is permanently affixed in both the structure of the pump member 406A and in structure segment 407E of housing part 407C. An opposite end of the tubular member communicates with an entry opening 488 leading to at least one acoustic chamber in the housing second portion 401B.

Tubular member 424 has ring like or similar protuberant like structure 444 encircling the outer periphery thereof, this to enable the tubular member to function as an air seal obviating any leakage in and around the region where pressurized air leaves the compressor pump and enters the sound generating structure carried in housing part 407C. The tubular member 424 is fixedly, permanently mounted to structures 406A and 407B. Such fixing can be by a number of ways as, for example, with thermal or radiant bounding, press fitment, as well as others of affixing means effective to the purpose at hand of permanently affixing the tubular member in the assembly.

Carried within housing parts 407A and 407B are fins 428 disposed longitudinally of the respective housing parts and which extend downwardly from the flange pieces 432A at the tops of these housing parts 407A, 407B. The fins 428 at lower ends thereof have joinder to lower flanges pieces 432B. Inner edges of flange pieces 432A, 432B terminate slightly radially outwardly of the inner edges of the fins 428 so that when the assembly is subjected to final affixing tightening, the fins have a slight engagement with the outside of motor housing 414.

Extending downwardly from compressor unit top side part 409 is a motor housing 414 which encircles and is affixed to drive motor structure (not shown) employed to power the compressor pump unit 406A. Motor housing 414 is provided with an opening 438 employed in cooperation with an alignment member 426 to effect necessary and proper registering of longitudinal alignment of the compressor unit with and within the housing structure of the assembled together housing parts 407A, 407B and 407C. It is noted that the inner structure envelope of these housing parts present a cylindraceous receiving profile in correspondence to the like outer configured profile of the compressor unit 406 to be encirclingly received therein. As best seen in FIG. 9, the alignment member 426 is an enlarged cylinder stepped down to smaller cylinder dimension at the front end thereof. The large body part is received in a companion configured pocket part 442 of housing part segment 407E. The alignment member is permanently affixed in the pocket and in the assembled structure, its stepped down front end passes thru opening 438 in the motor housing, this mating assuring that proper housing compressor unit alignment is achieved.

The motor housing 414 compressor unit 406 will be permanently affixed to other structure of the compressor pump unit 406 A other drive motor portions as needed. For that purpose, the locking means such as spring means 115, 127A seen in FIG. 3 or such means 215 in FIG. 5 can be employed. Also, alignment member 428 will be affixed in pocket part 442 of housing segment 407E. Similarly, the tubular member 424 is affixed to the structure of the compressor pump unit 406A. The compressor unit is then juxtaposed with the open face side of housing part segment 407B to align and insert these two members in companion receptive parts of the segment 407E. In effecting this, the tubular member 424 has been inserted in the compressor pump unit in communication with air outlet 430, and the alignment member 426 is passed thru opening 430 in motor housing 414, and housing part 407B partly girds the compressor unit 406. The housing part 407A is then girded about the still ungirded portion of the compressor unit 406. In effecting this girding encirclement of the compressor unit, longitudinal flange extensions 450 on housing part 407A with engage in companion right angle slots 452 on the housing part 407B. The extensions 450-slots 452 structure having juxtaposed engagement are permanently affixed to each other by thermal or radiant bonding, electric welding, adhesive or other suitable affixing means.

Figure 10:
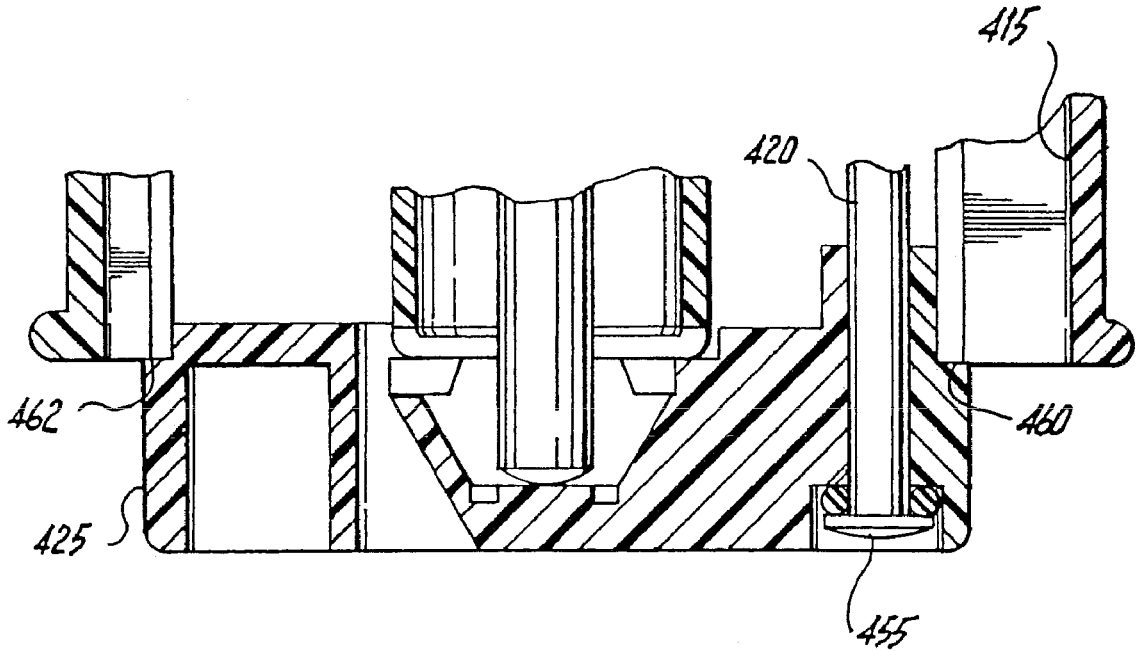
FIG. 10 is a fragmentary sectional view depicting the seal cap mounting attached to the bottom of the compressor unit.

In completing the assembly, additional affixing is made as depicted in FIG. 10. Referring to that Figure and with, A bottom seal cap 425 similar to the seal cap 225 depicted in FIG. 5 is employed to close off the bottom of the compressor unit 406 and prevents entry of debris or water into the unit 400. The seal cap 425 is affixed to the compressor unit with a pair of elongated bolts 420 which pass up thru bottom seal cap 425, a bolt lower end having a bolt head 455 which stops against structure of the seal cap. An opposite bolt end is threaded as at 456 and this threaded portion is received in a blind threaded bore 457 formed in the structure of the compressor pump unit 406A, the bolts being drawn up tight in the compressor unit structure. In this condition, the lower edge 460 of motor housing 414 sits supported on an encircling ledge face 462 form on the seal cap. In stead of a ledge surface, the seal cap can be formed with a radially outwardly directed encircling skirt or flange (not shown in FIGS. 9 and 10) on which the motor housing lower edge 460 would sit.

In accordance with the invention, the components of the horn unit 406, are permanently affixed together and it is not possible to remove the compressor unit 406 from the housing structure. This is a result of a number of deterring construction features. Air seal tube 424 and alignment member 426 are affixed in structure of the monolithic housing and the compressor unit 406 in a manner that prevents movement therebetween, as well as preventing entry of debris and water into the unit.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. An electropneumatic horn assembly, comprising:

an electric compressor unit having at least a compressor air inlet and a compressor air outlet for the supply of compressed air;

a monolithic housing assembly having a first housing portion embodying an opening defining a space for reception of said compressor unit in first said housing portion, said housing assembly having a second housing portion;

a sound wave generator system substantially housed in said second housing portion;

said sound wave generator system including:

at least one acoustic chamber having an opening for introduction of compressed air, a membrane member provided with an opening for sound generation and at least one acoustic duct housed in said housing assembly and communicating between said at least one acoustic chamber and at least one horn outlet to propagate sound generated by said membrane member outside said horn;

air channeling means for communicating between said compressor air outlet of said compressor unit and said opening of said at least one acoustic chamber; and means for permanently affixing said electric compressor unit in said housing assembly whereby said means for permanently affixing prevents removal of said electric compressor unit and improves operational stability of said housing assembly.

2. An electropneumatic horn assembly in accordance with claim 1, in which said electric compressor unit is of a cylindraceous external configuration, said first housing portion reception space being of cylindraceous configuration companion to that of said electric compressor unit.

3. An electropneumatic horn assembly in accordance with claim 2, in which said housing first portion comprises housing first and second parti-circular parts permanently joinable together along opposite end edges of each to define said reception space and encircle said compressor unit, said housing second portion comprising a housing third part, said third housing part being permanently affixed to said housing second part.

4. An electropneumatic horn assembly in accordance with claim 3, in which said air channeling means includes a tubular member having communication at an end thereof with said electric compressor unit air outlet, an opposite end of said tubular member being in communication with said opening of said at least one acoustic chamber.

5. An electropneumatic horn assembly in accordance with claim 4, in which said tubular member is permanently affixed partly in said electric compressor unit structure and partly in said housing third part.

6. An electropneumatic horn assembly in accordance with claim 5, further comprising protuberant structure carried on an outer surface of said tubular member for engaging structure of said electric compressor unit and said housing third part in which said tubular member is mounted whereby air leakage through said mounting is prevented.

7. An electropneumatic horn assembly in accordance with claim 6, in which said protuberant structure comprises a course of encircling rings on said outer surface.

8. An electropneumatic horn assembly in accordance with claim 5, further comprising alignment means for aligning relative longitudinal positioning of said compressor unit in said housing first portion reception space to register said air compressor outlet with said air channeling means.

9. An electropneumatic horn assembly in accordance with claim 8, in which said alignment means comprises an elongated pin member having a thickened first length portion and a thinner length portion, said housing third part having a pocket therein in which said pin member thicker length portion is permanently affixed, said thinner length portion extending into said housing first portion reception space and into a holding engagement with said compressor unit structure.

10. An electropneumatic horn assembly in accordance with claim 1, in which said air compressor unit embodies an air compressor pump at a top end thereof, said air compressor unit having a bottom end opening, and means for sealing said bottom end to minimize an entry of debris and water into monolithic housing assembly through said air compressor bottom end.

11. An electropneumatic acoustic horn assembly, comprising:

a electric compressor unit having at least a compressor air inlet and a compressor air outlet for the supply of compressed air, and a first end and opposing second end, said electric compressor unit being of cylindraceous configuration;

a sound wave generator system substantially housed in a monolithic housing assembly, said monolithic housing assembly having a monolithic compressor housing portion having a cylindraceous configured receiving opening;

said sound wave generator system comprising:

at least one acoustic chamber having an opening for the introduction of said pressurized air, a membrane member provided with an opening for sound generation and at least one acoustic duct housed in said monolithic housing assembly and communicating between said at least one acoustic chamber and at least one horn outlet to propagate sound generated by said membrane member outside said horn;

air channeling means for communicating between said compressor air outlet of said electric compressor unit and said opening of said at least one acoustic chamber;

means for permanently affixing said electric compressor unit in said monolithic housing assembly of said sound wave generator system, said first end of said electric compressor unit being a compressor member;

a motor housing affixedly joining said compressor unit, said means for permanently affixing further comprising:

spring engagement means for elastically engaging and permanently fixing said electric compressor unit in said cylindraceous configured receiving opening, thereby improving operational reliability of said assembly.

12. An electropneumatic acoustic horn assembly, according to claim 11, further comprising:

an electrical brush housing portion;

means for securing said electrical brush housing portion at said second opposing end of said electric compressor unit; and said means for securing said electrical brush housing portion being one of a removable means for securing and a permanent means for securing.

13. An electropneumatic acoustic horn assembly, according to claim 12, further comprising:

means for sealing said electrical brush housing portion to a sealing surface of said monolithic compressor housing portion, whereby said means for sealing minimizes one of a debris and a water entry to said electric compressor unit and improves operational reliability of said assembly.

14. An electropneumatic acoustic horn assembly, according to claim 11, wherein:

said spring engagement means includes a plurality of said spring locking tab members and a corresponding plurality of said corresponding locking tab receiving grooves; and respective ones of said plurality of tab members and said receiving grooves are arrayed about respective ones of said receiving opening and said compressor side walls.

15. An electropneumatic acoustic horn assembly, according to claim 11, further comprising:

means for aligning said cylindraceous compressor unit and said compressor air outlet with said opening in said acoustic chamber for said introduction of said pressurized air;

said means for aligning including at least one alignment member and at least one alignment groove having complementary shapes for interfitting during said assembly, whereby said alignment member and said groove are slidingly arranged to align said compressor air outlet with said opening.

16. An electropneumatic acoustic horn assembly, according to claim 11, wherein:

said means for permanently fixing said electric compressor unit in said monolithic housing assembly of said sound wave generator system further comprises, at least one of a group comprising:

spring engagement means for elastically engaging and permanently fixing said cylindraceous electric compressor unit in said cylindraceous receiving opening, thermal welding means for thermally welding portions of said cylindraceous electric compressor unit with said monolithic compressor housing portion, and adhesively fixing means for adhesively bonding portions of said cylindraceous electric compressor unit with said monolithic compressor housing portion, whereby said means for permanently fixing improves operational reliability of said assembly.

17. An electropneumatic acoustic horn assembly, according to claim 11, wherein:

said at least one horn outlet includes means for minimizing at least one of a debris and a water entry into said horn outlet during a use of said assembly; and and said means for minimizing includes at least one selected from a group comprising: an opening seal sealing said at least one horn outlet; at least one flexible louver member flexibly covering said at least one horn outlet; at least one flexible shield member pivotably covering said at least one horn outlet, and at least one of a woven and a metal mesh, whereby said at least one minimizing means enables a release of sound from said at least one horn outlet while minimizing entry of debris and water into said monolithic housing assembly.

18. An electropneumatic acoustic horn assembly, according to claim 17, further comprising:

at least one housing air inlet passage in said monolithic housing assembly;

at least one compressor air inlet passage in said monolithic compressor housing portion communicating from said at least one housing air inlet passage to said compressor air inlet;

at least one air inlet including at least one means for minimizing at least one of a debris entry and a water entry during a use of said assembly; and and said means for minimizing includes at least one selected from a group comprising: an opening seal sealing said at least one air inlet; and at least one of a woven and a metal mesh covering said at least one air inlet, whereby said at least one minimizing means enables entry of feed air to said electric compressor air unit while minimizing entry of debris and water into said monolithic housing assembly.

19. An electropneumatic acoustic horn assembly, according to claim 11, further comprising:

means for securing said monolithic housing assembly to an external support member, and said means for securing including at least one selected from the group comprising: a protruding mounting bracket member, a magnetic mounting member, a suction-based mounting member, an adhesive mounting member, and a strap mounting member, whereby said means for securing enables ready attachment of said assembly to said external support member.

20. An electropneumatic acoustic horn assembly, comprising:

a cylindraceous electric compressor unit having at least a compressor air inlet and a compressor air outlet for the supply of compressed air;

a sound wave generator system substantially housed in a monolithic housing assembly, said monolith housing having a cylindraceous opening therein;

said sound wave generator system comprising:

at least one acoustic chamber having an opening for the introduction of said pressurized air, a membrane member provided with an opening for sound generation and at least one acoustic duct housed in said monolithic housing assembly and communicating between said at least one acoustic chamber and at least one horn outlet to propagate sound generated by said membrane member outside said horn;

air channeling means for communicating between said compressor air outlet of said electric compressor unit and said opening of said at least one acoustic chamber;

means for permanently affixing said electric compressor unit in said monolithic housing assembly of said sound wave generator system to prevent removal of said electric compressor unit therefrom, said permanent affixing means including at least one of a spring engagement means for elastically engaging and permanently fixing said electric compressor unit in said cylindraceous opening and a compressing engagement means for urging said electric compressor unit into said cylindraceous opening, whereby said means for permanently fixing prevents removal of said electric compressor unit and thereby improves operational reliability of said assembly;

said electric compressor unit having a first end and a second opposite end;

said first end of said electric compressor unit being a compressor member;

an electrical brush housing portion at said second opposite end;

a motor housing joining said electric compressor unit and said electrical brush housing portion; and said electrical brush housing portion including a projecting member for contacting a sealing portion of said monolithic compressor housing proximate said receiving opening.

21. An electropneumatic acoustic horn assembly, according to claim 20, wherein:

said cylindraceous opening includes opening side walls;

said compressor unit having compressor side walls;

said opening side walls and said compressor side walls being proximate each other upon an assembly of said electropneumatic acoustic horn assembly; and said spring engagement means including at least one spring locking tab member and at least one corresponding locking tab receiving groove; whereby during said assembly of said electropneumatic acoustic horn assembly said at least one springing locking tab urgingly engages said corresponding locking tab receiving groove and prevents removal of said compressor unit from said receiving opening.

22. An electropneumatic acoustic horn assembly, according to claim 21, wherein:

said spring engagement means includes a plurality of said spring locking tab members and a corresponding plurality of said corresponding locking tab receiving grooves; and respective ones of said plurality of tab members and said receiving grooves are arrayed about respective ones of said receiving opening and said compressor side walls.

23. An electropneumatic acoustic horn assembly, according to claim 21, further comprising:

means for aligning said cylindraceous compressor unit and said compressor air outlet with said opening in said acoustic chamber for said introduction of said pressurized air;

said means for aligning including at least one alignment member and at least one alignment groove having complementary shapes for interfitting during said assembly, whereby said alignment member and said groove are slidingly arranged to align said compressor air outlet with said opening.

24. An electropneumatic acoustic horn assembly, according to claim 21, wherein:

said at least one horn outlet includes means for minimizing at least one of a debris and a water entry during a use of said assembly; and and said means for minimizing includes at least one selected from a group comprising: an opening seal sealing said at least one horn outlet; at least one flexible louver member flexibly covering said at least one horn outlet; at least one flexible shield member pivotably covering said at least one horn outlet, and at least one of a woven and a metal mesh, whereby said at least one minimizing means enables a release of sound from said at least one horn outlet while minimizing entry of debris and water into said monolithic housing assembly.

25. An electropneumatic acoustic horn assembly, according to claim 21, further comprising:

at least one housing air inlet passage in said monolithic housing assembly;

at least one compressor air inlet passage in said monolithic housing assembly communicating from said at least one housing air inlet passage to said compressor air inlet;

at least one air inlet including at least one means for minimizing at least one of a debris entry and a water entry during a use of said assembly; and and said means for minimizing includes at least one selected from a group comprising: an opening seal sealing said at least air inlet; at least one flexible louver member flexibly covering said at least one air inlet; at least one flexible shield member pivotably covering said at least one air inlet, and at least one of a woven and a metal mesh covering said at least one air inlet, whereby said at least one minimizing means enables entry of feed air to said electric compressor air unit while minimizing entry of debris and water into said monolithic housing assembly.

26. An electropneumatic acoustic horn assembly, according to claim 24, further comprising:

at least one housing air inlet passage in said monolithic housing assembly;

at least one compressor air inlet passage in said monolithic compressor housing portion communicating from said at least one housing air inlet passage to said compressor air inlet;

and said means for minimizing includes at least one selected from a group comprising: an opening seal sealing said at least one air inlet; at least one flexible louver member flexibly covering said at least one air inlet; at least one flexible shield member pivotably covering said at least one air inlet, and at least one of a woven and a metal mesh covering said at least one air inlet, whereby said at least one minimizing means enables entry of feed air to said electric compressor air unit while minimizing entry of debris and water into said monolithic housing assembly.

27. An electropneumatic acoustic horn assembly, according to claim 25, wherein:

said at least one housing air inlet passage in said monolithic housing assembly is proximate said electrical brush housing portion at said second opposing end; and said at least one compressor air inlet passage extending from said air inlet passage through said monolithic housing assembly to said compressor air inlet at said first end of said electric compressor unit.

28. An electropneumatic acoustic horn assembly, according to claim 21, further comprising:

means for securing said monolithic housing assembly to an external support member, and said means for securing including at least one selected from the group comprising: a protruding mounting bracket member, a magnetic mounting member, a suction-based mounting member, an adhesive mounting member, and a strap mounting member, whereby said means for securing enables ready attachment of said assembly to said external support member.

29. An electropneumatic acoustic horn assembly, according to claim 21, wherein:

said means for urging said electric compressor unit into a receiving opening in said monolithic compressor housing and fixing said electric compressor unit therein further comprises:

said projecting member of said electrical brush housing portion;

at least one threaded member projecting from said electrical brush housing portion at said second opposition end and threadably engaging said compressor member at said first end during said assembly, whereby during said assembly a tightening of said threaded member secures said compressor unit to said monolithic compressor housing.

30. An electropneumatic acoustic horn assembly, comprising:

an electric compressor unit having at least a compressor air inlet and a compressor air outlet for the supply of compressed air;

a sound wave generator system substantially housed in a monolithic housing assembly;

said sound wave generator system comprising:

at least one acoustic chamber having an opening for the introduction of said pressurized air, a membrane member provided with an opening for sound generation and at least one acoustic duct housed in said monolithic housing assembly and communicating between said at least one acoustic chamber and at least one horn outlet to propagate sound generated by said membrane member outside said horn;

air channeling means for communicating between said compressor air outlet of said electric compressor unit and said opening of said at least one acoustic chamber;

means for permanently fixing said electric compressor unit in said monolithic housing assembly of said sound wave generator system, whereby said means for permanently fixing prevents removal of said electric compressor unit and improves operational reliability of said assembly;

said monolithic housing assembly including a first arc housing portion and a separate second arc housing portion; and means for permanently bonding together companion juxtaposable end wall surfaces of each of said first and second arc housing portions following an assembly of said electropneumatic acoustic horn assembly, whereby an operational reliability and ease of assembly of said electropneumatic acoustic horn assembly is operationally improved.

31. An electropneumatic acoustic horn assembly according to claim 30, wherein said permanently bonding means comprises thermal welding.

32. An electropneumatic acoustic horn assembly according to claim 30, wherein said permanently bonding means comprises a latch member in one of two companion juxtaposable wall surfaces, and a latching recess in a other of said companion wall surfaces in which said latch member is non-removably latched.

33. An electropneumatic acoustic horn assembly according to claim 30, wherein said alignment members are carried on one of two companion juxtaposable wall surfaces, and alignment member receiving openings are carried in another of said companion wall member for effecting proper assembly alignment of said one arc housing portion with said second arc housing portion.

34. An electropneumatic acoustic horn assembly, comprising:

an electric compressor unit having at least a compressor air outlet and a compressor air inlet for supply of compressed air, said electric compressor unit having a cylindraceous outer configuration, a top of said electric compressor unit being a compressor member;

a monolithic housing, a fixing skirt carried at a top end of said monolithic housing, said fixing skirt encircling a receiving opening in said fixing skirt top end, said electric compressor unit being inserted through said housing receiving opening into a first interior portion of said housing, said electric compressor unit having a bottom opening;

means for permanently affixing the top of said compressor unit to said fixing skirt;

a sound wave generator system substantially housed in another portion of said housing, said sound wave generator system comprising:

at least one acoustic chamber having an opening for the introduction of said compressed air, a membrane member provided with an opening for sound generation and at least one acoustic duct housed in said housing and communicating between said at least one acoustic chamber and at least one horn outlet to propagate sound generated by said membrane member outside said horn;

means for communicating said compressed air outlet with said opening of said at least one acoustic air chamber;

a bottom brush housing member for closing said electric compressor unit bottom opening; and a bottom seal cap enclosing said brush housing member and a housing bottom opening proximal said bottom housing bottom opening, said brush housing member being permanently affixed to said bottom seal cap.

* * * * *